US005632177A

United States Patent [19]

Narita et al.

[11] Patent Number: 5,632,177

[45] Date of Patent: May 27, 1997

[54] SYSTEM AND METHOD FOR MANUFACTURING THIN PLATE BY HOT WORKING

[75] Inventors: Kenjiro Narita, Hitachi; Ken-ichi Yasuda, Hitachinaka; Yukio Hirama, Mito; Kouji Satou, Hitachi; Ken-ichi Yoshimoto, Hitachi; Tadashi Nishino, Hitachi; Shinichi Kaga, Hitachi; Yasutsugu Yoshimura, Hitachi, all of Japan

[73] Assignee: Hitachi, Ltd., Tokyo, Japan

[21] Appl. No.: 407,871

[22] Filed: Mar. 20, 1995

Related U.S. Application Data

[63] Continuation-in-part of Ser. No. 203,314, Mar. 1, 1994.

[30] Foreign Application Priority Data

Mar. 18, 1994 [JP] Japan ..... 6-048250

[51] Int. Cl.[6] ..... B21B 31/07

[52] U.S. Cl. ..... 72/249; 72/206; 72/234; 72/366.2; 29/527.7

[58] Field of Search ..... 29/527.7; 72/234, 72/249, 184, 188, 206, 366.2

[56] References Cited

U.S. PATENT DOCUMENTS

| | | | |
|---|---|---|---|
| 4,599,883 | 7/1986 | Ginzburg et al. | 72/234 |
| 4,802,356 | 2/1989 | Yamada et al. | 72/184 |
| 4,817,703 | 4/1989 | Rohde et al. | 29/527.7 |
| 4,998,338 | 3/1991 | Seidel et al. | 29/527.7 |
| 5,121,873 | 6/1992 | Sekiya et al. | 29/527.7 |
| 5,205,471 | 4/1993 | Kinose et al. | 29/527.7 |
| 5,219,114 | 6/1993 | Kajiwara et al. | 72/234 |
| 5,329,688 | 7/1994 | Aruedi et al. | 29/527.7 |
| 5,461,770 | 10/1995 | Kimura et al. | 29/527.7 |

FOREIGN PATENT DOCUMENTS

| | | | |
|---|---|---|---|
| 22500 | 2/1980 | Japan . | |
| 90303 | 4/1988 | Japan . | |
| 132703 | 6/1988 | Japan . | |
| 228207 | 8/1992 | Japan . | |
| 47654 | 2/1994 | Japan . | |
| 6122002 | 5/1994 | Japan | 72/366.2 |
| 9222389 | 12/1992 | WIPO | 29/527.7 |

*Primary Examiner*—Lowell A. Larson
*Assistant Examiner*—Ed Tolan
*Attorney, Agent, or Firm*—Evenson McKeown Edwards & Lenahan, PLLC

[57] ABSTRACT

In a system and method for manufacturing thin plate by hot-working, a splicing machine for continuously splicing the front edge of a following plate and the rear edge of a precedent plate is provided in the process precedent to a set of rolling mill stands having non-driven small diameter working rollers. By continuously splicing the plates, most portions of the rolled plates can be rolled under a steady state rolling condition, that is, an after-engaged rolling condition, and the thickness reducing amount of the plates in most portions of the rolled material is substantially increased, which substantially improves the rolling efficiency. Thereby, the diameter of the working rollers can be decreased smaller than the diameter of working roller used in a conventional rolling mill, rolling mill strands can be made small, and it can be realized to attain a small-scale system for manufacturing thin plate by hot working.

74 Claims, 21 Drawing Sheets

SYSTEM AND METHOD FOR MANUFACTURING THIN PLATE BY HOT WORKING

This is a continuation-in-part application of application Ser. No. 08/203,314 filed Mar. 1, 1994.

BACKGROUND AND SUMMARY OF THE INVENTION

The present invention relates to a system and a method for manufacturing thin plate by hot working, and more particularly to a system for manufacturing a plate by hot working and a method for manufacturing a plate by hot working suitable for stably manufacturing high quality plates using a compact manufacturing system.

In a conventional system for manufacturing thin plate by hot working, a slab having a thickness of more than 200 mm is casted using a continuous casting machine. The slab, as a base material, is single-directionally or reversely rolled to produce a bar material using a plurality of coarse rolling mills. Then the bar material is rolled to a given thickness using a plurality of tandem finishing rolling mills for finishing and is subsequently wound up using a down coiler coiling unit to form a steel strip. The system for manufacturing thin plate by hot working described above is used in massive production plants and requires an extremely huge system having a length from a heating furnace in the up-stream end to a wind-up machine in the downstream end which is more than 300 m (meters).

In recent years, it has been regarded as important to recycle iron scrap due to generation of a massive amount of iron scrap. Thus there is a desire in the industry to distributively install small scale and small production manufacturing plants rather than to concentrate production at a large scale and massive production manufacturing plant. Consequently there arises a need for a small scale rolling mill system.

For obtaining a small scale system, there have been various methods and systems proposed to decrease the number of rolling mill stands. For example, in Japanese Patent Application Laid-Open No. 63-90303 (1988), there is proposed a hot working rolling mill system where at least one among a set of hot working rolling mills is a reverse rolling mill, and an edger is provided in the inlet side or in the outlet side of the reverse rolling mill.

Another method for obtaining a small scale system is to decrease the number of rolling mill units by increasing the plate thickness reduction amount per rolling operation. For example, in Japanese Patent Application Laid-Open No. 63-132703 (1988), there is proposed a method where rolling is performed by at maximum three or four roll stands of rolling mills provided in the process following a continuous casting machine. In this system two of the roll stands in the front stage have large diameter working rollers.

Another method proposed for obtaining a small scale system is to decrease the number of roll stands of rolling mills or the number of passing-through times for rolling by improving efficiency of rolling. For example, in Japanese Patent Application Laid-Open No. 55-22500 (1980), there is proposed a method where a coarse rolling mill working under a high pressure is arranged in the front of a line of finishing rolling mills.

The system described in Japanese Patent Application Laid-Open No. 63-90303 (1988) has a disadvantage in that a complex handling technique is required in performing reverse rolling and, in addition to this, a wide space is required for treating plates after passing-though times for rolling of even numbers in the front side of a finishing rolling mill since reverse coarse rolling is performed using one or more pairs composed of a reverse rolling mill and an edger which are installed in the set of rolling mills and then finishing tandem rolling is performed using the whole of the rolling mills.

The system described in Japanese Patent Application Laid-Open No. 63-132703 (1988) has a disadvantage in that the system becomes large-scale and complex since the large diameter working rollers increase the load of rolling and larger diameter reinforcing rollers having sufficient shaft strength for carrying the rolling loads are required.

Further, the system described in Japanese Patent Application Laid-Open No. 55-22500 (1980) has a disadvantage in that a slab pushing apparatus and a slab drawing apparatus are required to perform the coarse rolling under the high pressure rolling condition. Thus the rolling method and rolling system are complex, and a space for the slab drawing apparatus is required between the coarse rolling mills operating under the high pressure rolling condition and the finishing rolling mills.

The present invention is made under the situation described above. An object of the present invention is to provide a system and method for manufacturing a plate by hot working which is capable of stably manufacturing high quality plates using a compact manufacturing system having a short overall system length.

The present invention makes it possible to provide a system and method for manufacturing a plate by hot working which is capable of stably manufacturing high quality plates using a compact manufacturing system by combining and installing sets of rolling mill stands having small diameter working rollers and a splicing machine for thin plates to assure continuous engaging capability of the rolling mill stands having the small diameter working rollers.

According to one aspect of the invention, the above noted object is achieved according to the present invention by providing a system for manufacturing thin plate by hot working having a set of finish rolling mill stands for hot rolling thin plate from its case thickness to a finish thickness, the rolling mill stands having indirectly driven small diameter working rollers, and a splicing machine for continuously splicing said thin plate located upstream of these rolling mill stands. In preferred embodiments of the invention the thin plate is cast to a thickness of less than 100 mm and the working rollers of the finish rolling mill stands have a diameter substantially smaller than conventional working rollers of 700 mm–800 mm. In preferred embodiments of the invention the diameter of the working rollers is less than 600 mm and working roller diameters between 300 mm and 400 mm are especially preferred.

In this description, the terms "non-driven" and "indirectly driven" are used to describe working rollers which are not rotatably driven by driving means engaged at the working roller end portion (or neck portions) outside the location of the strip being rolled. These "non-driven" and "indirectly driven" working rollers are instead driven by supporting rollers in the form of backup rollers for four-high mill stands and intermediate rollers for six-high mill stands.

According to another aspect of the present invention, a front edge press for tapering the front edge portion of said thin plate and a splicing machine for continuously splicing said thin plate are provided in the process precedent to the set of rolling mills with small diameter non-driven or indirectly driven working rolls.

According to another aspect of the present invention, in a system for manufacturing thin plate by hot working having a set of rolling mills for rolling thin plate, a rolling mill having non-driven or indirectly driven small diameter working rollers is arranged downstream of a splicing machine for continuously splicing said thin plate, a winding-off coiler is provided upstream of the splicing machine, a tunnel furnace for taking up, transferring and discharging a coil of plate is provided upstream of the winding-off coiler, a winding-up coiler is provided upstream of the tunnel furnace, a soaking pit is provided upstream of the winding-up coiler, one or more continuous casting machines for casting thin plate are provided upstream of the soaking pit, and a down-coiler or a chain wrapper is provided downstream of the set of rolling mills.

According to another aspect of the present invention, in a system for manufacturing thin plate by hot working having a set of rolling mills for rolling thin plate, a rolling mill having non-driven or indirectly driven small diameter working rollers is arranged downstream of a splicing machine for continuously splicing said thin plate, a heating furnace capable of discharging said thin plate is provided upstream of the splicing machine, a soaking pit capable of taking-up, transferring and discharging said thin plate is provided upstream of the heating furnace, one or more continuous casting machines for casting thin plate are provided upstream of the soaking pit, and a down-coiler or a chain wrapper is provided in the process downstream of the set of rolling mills. This system is a low cost compact system requiring minimal space and length of the production line.

In certain preferred embodiments of the invention, a front edge press for tapering the front edge portion of said thin plate has anvil blocks with a taper portion and a parallel portion. With this arrangement, unnecessary moving of the thin plate is eliminated and smooth pressing can be performed. This tapered front edge portion facilitates start up engagement or "biting" of a strip of plates with the working rollers.

In certain preferred embodiments of the invention, a front edge press for tapering the front edge portion of said thin plate includes rotatable upper and lower anvil blocks, an off-set being provided between a line connecting between the upper and the lower rotating centers of the anvil blocks and the minimum bite gap portion between the upper and the lower anvil blocks. With this arrangement, unnecessary contact between the thin plate and the anvil blocks is eliminated and smooth pressing can be performed. This tapered front edge portion facilitates start up engagement or "biting" of a strip of plates with the working rollers.

In certain preferred embodiments a machine is provided for increasing the friction coefficient between the working rollers at a first mill stand and a plate to be rolled.

In certain preferred embodiments, the machine for increasing friction coefficient is a machine to grind a working roller installed in a rolling mill, for example, a rotating grinding stone.

In certain preferred embodiments, the machine for increasing friction coefficient is a machine for forming projections and depressions on the surface of the front edge of a thin plate.

In certain preferred embodiments, the machine for increasing friction coefficient is a machine for supplying friction increaser between a roller and a plate to be rolled.

In certain preferred embodiments the splicing machine comprises a cutter for cutting the rear edge of a precedent plate and the front edge of the following plate, a melt-planing device having a plurality of melt-planing torches arranged in the width direction of the plate, transferring means for moving said melt-planning torches in the width direction of the plate, and pressing means for applying pressing force to the interface of the rear edge of the precedent plate and the front edge of the following plate.

In certain preferred embodiments of the invention, the splicing machine comprises cutting means for cutting the rear edge of a precedent plate and the front edge of the following plate, induction heating coils arranged at the upper and the lower surfaces of said plate to inductively heat the butt surfaces of the plates, and pressing means for applying pressing force to the interface of said butt surfaces.

In certain preferred embodiments of the invention, the splicing machine comprises cutting means for cutting the rear edge of a precedent plate and the front edge of the following plate, arc generating means for locally generating arc by conducting current in the gap between butt surfaces of the plates, arc transferring means for moving said arc generating means in the width direction of the plate, and pressing means for applying pressing force to the butt interface of the rear edge of the precedent plate and the front edge of the following plate.

In certain preferred embodiments of the invention, the splicing machine comprises cutting means for cutting the rear edge of a precedent plate and the front edge of the following plate, oxygen gas jetting means for jetting oxygen gas to at least one edge surface of the rear edge of the precedent plate and the front edge of the following plate, iron powder mixing means for mixing iron powder in the oxygen gas, and pressing means for applying pressing force to the contacting surfaces of the rear edge of the precedent plate and the front edge of the following plate.

In certain preferred embodiments of the invention, the splicing machine comprises cutting means for cutting the rear edge of a precedent plate and the front edge of the following plate, plate vibrating means for vibrating at least one of the rear edge of the precedent plate and the front edge of the following plate, and pressing means for applying pressing force to the contacting surfaces of the rear edge of the precedent plate and the front edge of the following plate.

In certain preferred embodiments of the invention, the splicing machine comprises pressing means for superposing and pressing the rear edge of the precedent plate and the front edge of the following plate, sliding means for sliding the rear edge of said precedent plate and the front edge of said following plate superposed and pressed against each other, and means for forming at least one indent portion on at least one of the superposed surfaces of the rear edge of said precedent plate and the front edge of said following plate.

In certain preferred embodiments of the invention, the splicing machine comprises thinning means for thinning each of the rear edge of the precedent plate and the front edge of the following plate, pressing means for superposing and pressing the rear edge of the precedent plate and the front edge of the following plate thinned with said thinning means, sliding means for sliding the rear edge of said precedent plate and the front edge of said following plate superposed and pressed against each other, and said thinning means having means for forming at least one indent portion on at least one of the superposed surfaces of the rear edge of said precedent plate and the front edge of said following plate.

Each of these above-noted arrangements for performing the continuous splicing of plates provides for economical and efficient splicing which facilitates the achievement of the overall desired minimum size compact system.

In certain preferred embodiments of the invention, the set of rolling mills or stands are constructed such that at least a first front rolling mill stand or first and second front rolling mill stands are four-high rolling mill stands. Thus, these first or first and second stage rolling mill stands are advantageously of a small compact size.

In certain preferred embodiments of the invention, the set of rolling mill stands are constructed such that at least a first front rolling mill stand or first and second front rolling mill stands have working rollers made of a material for high temperature and the other downstream rolling mill stands have working rollers made of a material for low temperature, the materials for the working rollers being different from each other. With this arrangement, it is possible to roll a comparatively high temperature plate and maintain relatively high temperature rolling operations.

In certain preferred embodiments of the invention, at least one rolling mill stand among said set of rolling mill stands is a rolling mill stand wherein the working rollers are adjustably movable in the direction of the working roller axes. This arrangement facilitates maintenance of high quality rolled plate.

In certain preferred embodiments of the invention, at least one rolling mill stand among said set of rolling mill stands is such a rolling mill stand that the upper and the lower working rollers are adjustably crossed in the horizontal plane with respect to each other to vary the gap between the rollers. This arrangement further facilitates maintenance of high quality rolled plates.

In certain preferred embodiments of the invention, at least one rolling mill stand among said set of rolling mill stands is a six-high rolling mill stand that has intermediate rollers capable of moving in the axial direction and a working roller bender. This arrangement further facilitates maintenance of high quality rolled plates.

According to an aspect of the present invention, in a method for manufacturing steel strip by hot working using a system for manufacturing thin plate by hot working having a set of rolling mill stands for rolling thin plate, the method comprises continuously splicing a precedent thin plate and the following thin plate, then rolling said thin plates using said set of rolling mill stands, including at least one mill stand having non-driven or indirectly driven small diameter working rollers, to manufacture a steel strip, According to another aspect of the present invention, in a method for manufacturing steel strip by hot working using a system for manufacturing thin plate by hot working having a set of rolling mill stands for rolling thin plate, the method comprises tapering the front edge of a thin plate using a front edge press, then rolling the thin plate using the set of rolling mill stands having non-driven or indirectly driven small diameter working rollers when said thin plate is rolled in the first place by said set of rolling mill stands and continuously splicing a precedent thin plate and the following thin plate, then said thin plates are rolled by said set of rolling mill stands using said set of rolling mill stands having non-driven or indirectly driven small diameter working rollers to manufacture a steel strip from the thin plates following the first thin plate. The tapering by the front edge press facilitates the start up of rolling by accommodating entry of the leading edge into the working rollers.

According to another aspect of the present invention, in a method for manufacturing thin plate by hot-working having a set of rolling mills for rolling thin plate, the method comprises, in rolling a first plate using said set of rolling mills, rolling a plate to be rolled using the set of rolling mills with a rolling mill having non-driving small diameter working rollers after engaging said plate in a state of increasing friction coefficient between the roller and said plate, and in rolling the plates following the first plate using said set of rolling mills, rolling the plate to be rolled using said set of rolling mills having non-driving small diameter working roller after continuously splicing the rear edge of a precedent plate to the front edge of the following plate.

According to another aspect of the present invention, in a method for manufacturing steel strip by hot working using a system for manufacturing thin plate by hot working having a set of rolling mill stands for rolling thin plate, the method comprises casting a thin plate using one or more continuous casting machines, winding up the thin plate to form a coil-shape using a winding-up coiler, warming or heating said coil-shaped thin plate in a tunnel furnace, winding off the coil-shaped thin plate warmed or heated in said tunnel furnace, continuously splicing said thin plate wound-off, rolling said thin plates which are spliced by said set of rolling mill stands having non-driven or indirectly driven small diameter working rollers, and winding up said rolled thin plate using a down-coiler or a chain wrapper.

According to another aspect of the present invention, in a method for manufacturing steel strip by hot working using a system for manufacturing thin plate by hot working having a set of rolling mill stands for rolling thin plate, the method comprises casting a thin plate using one or more continuous casting machines, warming or heating said thin plate in a soaking pit, transferring said thin plate warmed or heated in the soaking pit to a heating furnace to heat the thin plate at a given temperature in said heating furnace, continuously splicing said thin plate heated at the given temperature in said heating furnace, rolling said thin plates which are spliced by said set of rolling mill stands having non-driven or indirectly driven small diameter working rollers, and winding up said thin plate rolled using a down-coiler or a chain wrapper.

In certain preferred embodiments of the invention, the method comprises tapering the front edge portion of said thin plate using a front edge press having anvil blocks with a taper portion and a parallel portion.

In certain preferred embodiments of the invention, the method comprises tapering the front edge portion of said thin plate using a front edge press having rotatable upper and lower anvil blocks, an off-set being provided between the line connecting between the upper and the lower rotating centers and the minimum bite gap portion between the upper and the lower anvil blocks.

In certain preferred embodiments of the invention, the method of splicing said thin plates comprises cutting the rear edge of a precedent plate and the front edge of the following plate perpendicular to the rolling direction, melt-planing at least one of the rear edge of the precedent plate and the front edge of the following plate in the width direction of the rolled plate by blowing jet flow of melt-planing torches to a portion with a given width from the edge, forming a splicing surface on the edge surface by melt-planning, and applying pressing force to the splicing surfaces to splice the thin plates.

In certain preferred embodiments of the invention, the method of splicing said thin plates comprises cutting the rear edge of a precedent thin plate and the front edge of the following thin plate, butting the rear edge of the precedent thin plate and the front edge of the following thin plate with a gap between the rear edge of the precedent thin plate and the front edge of the following thin plate, inductively heating the butt surfaces of the thin plates by induction heating coils arranged at the upper and the lower surfaces of said thin plate, and applying pressing force to the interface of said butt surfaces to splice the rear edge of the precedent thin plate and the front edge of the following thin plate.

In certain preferred embodiments of the invention, the method of splicing said thin plates comprises cutting the rear edge of a precedent thin plate and the front edge of the following thin plate, butting the rear edge of the precedent thin plate and the front edge of the following thin plate with a gap between the rear edge of the precedent thin plate and the front edge of the following thin plate, conducting direct current in the gap to locally generate arc and concurrently applying an alternating magnetic field in the thickness direction of said gap to create magnetic force in the width direction to said arc, heat-melting each of the rear edge of the precedent thin plate and the front edge of the following thin plate in the width direction of the thin plates by the arc moving in the width direction of the thin plates, forming a splicing surface in each of the edges, and applying pressing force to the interface of said butt surfaces to splice the rear edge of the precedent thin plate and the front edge of the following thin plate.

In certain preferred embodiments of the invention, the method of splicing said thin plates comprises cutting the rear edge of a precedent thin plate and the front edge of the following thin plate, jetting oxygen gas and iron powder, as required, to at least one edge surface of the rear edge of the precedent plate and the front edge of the following plate to heat-melt and concurrently to blow off oxidized scales, forming a splicing surface in each of the rear edge of the precedent thin plate and the front edge of the following thin plate, and applying pressing force to the splicing surfaces to splice the rear edge of the precedent plate and the front edge of the following plate.

In certain preferred embodiments of the invention, the method of splicing said thin plates comprises cutting the rear edge of a precedent thin plate and the front edge of the following thin plate, vibrating at least one edge surface of the rear edge of the precedent plate and the front edge of the following plate to form splicing surfaces, and applying pressing force to the splicing surfaces to splice the rear edge of the precedent plate and the front edge of the following plate.

In certain preferred embodiments of the present invention, the method for splicing plates comprises the steps of superposing the rear edge of a precedent plate and the front edge of the following plate, forming at least one indent portion on at least one of said superposed surfaces, superposing and pressing the rear edge of said precedent plate and the front edge of said following plate, then sliding the rear edge of said precedent plate and the front edge of said following plate superposed and pressed against each other to join the precedent plate to said following plate.

In certain preferred embodiments of the present invention, the method for splicing plates comprises the steps of thinning each of the rear edges of a precedent plate and the front edge of the following plate, and further during thinning the edges, forming at least one indent portion on at least one of the surfaces of the rear edge of said precedent plate and the front edge of said following plate to be superposed, superposing and pressing the rear edge of said precedent plate and the front edge of said following plate, then sliding the rear edge of said precedent plate and the front edge of said following plate superposed and pressed against each other to join said precedent plate to said following plate.

In certain preferred embodiments of the invention, the method comprises rolling said thin plate using said set of rolling mill stands constructed such that at least a first front rolling mill stand or first and second front rolling mill stands are four-high rolling mills.

In certain preferred embodiments of the invention, the method comprises rolling said thin plate using said set of rolling mill stands constructed such that at least a first front rolling mill stand or first and second front rolling mill stands have working rollers made of a material for high temperature and the other downstream rolling mill stands have working rollers made of a material for low temperature, the materials for the working rollers being different from each other.

In certain preferred embodiments of the invention, the method comprises rolling said thin plate using said set of rolling mill stands constructed such that at least one rolling mill stand among said set of rolling mill stands has working rollers which are adjustably movable in the direction of the roller axis.

In certain preferred embodiments of the invention, the method comprises rolling said thin plate using said set of rolling mill stands constructed such that at least one rolling mill stand among said set of rolling mill stands has upper and the lower working rollers which are adjustably crossed in the horizontal plane with respect to each other to vary the gap between the rollers.

In certain preferred embodiments of the invention, the method comprises rolling said thin plate using said set of rolling mill stands constructed such that at least one rolling mill stand among said set of rolling mill stands is a six-high rolling mill stand that has intermediate rollers capable of moving in the axial direction and a working roller bender.

In certain preferred embodiments of the invention, the method comprises passing a dummy strip through said set of rolling mill stands in advance of rolling a thin plate in the first place, splicing said dummy strip and said thin plate, and rolling said thin plate. With this arrangement the startup rolling operating can be facilitated by controlling the size and shape off the dummy plate, such as by tapering its front end.

In certain preferred embodiments of the invention, the method comprises passing a thin plate through said set of rolling mill stands under a light pressure rolling condition when the thin plate is rolled in the first place, then rolling the thin plate under a given pressure. This arrangement also facilitates start up rolling operation by facilitating pass through at the front portion of the spliced plates to be rolled.

In certain preferred embodiments of the invention, the method comprises performing rolling by a rolling schedule in which a thick plate is rolled in the first place. This arrangement also facilitates start up of rolling of spliced together plates and also minimizes the amount of waste plate material to be thrown away.

The following has been revealed from the results of study by the inventors of the present invention.

In order to modify a conventional large scale manufacturing type to a small scale one, it is necessary to improve a hot-rolling process which is a main part of the manufacturing process. It is inevitable to improve the rolling efficiency per rolling mill or rolling mill stand, and in addition to this to make the rolling mill small in scale and size.

On the other hand, in order to improve the rolling efficiency per rolling mill stand, it is required to increase the thickness reducing amount of plate per rolling mill stand. However, in connection with increase of the thickness reducing amount of plate, there is a relationship between the limit in the thickness reducing amount of plate for engaging the front end portion of a plate and the diameter of the working rollers. Therefore, when the thickness reducing amount of plate is forced to increase beyond the limit for engaging the front edge of a plate between the working rollers, rolling of a plate cannot be performed since the plate cannot be entered between the working rollers and the working rollers slip.

In the past as a technology to cope with the problem of start rolling described above, it has been attempted to increase the limit in the thickness reducing amount of plate and accommodate engaging of the front edge of a plate between the working rollers by increasing the diameter of the working rollers. Although it is possible to increase the limit in the thickness reducing amount of a plate for engaging the front edge of a plate by increasing the diameter of the working rollers, an increase in the diameter of the working roller increases rolling load and consequently the rolling mill becomes large in size.

Reducing the number of rolling mills or mill stands with improved rolling efficiency per rolling mill stand results in large-sized rolling mills. Making rolling mill stands small in size by decreasing the diameter of the working rollers results in a great number of rolling mill stands, which contradicts the object of attaining a small scale manufacturing plant.

In the past as a technology to cope with the above, as described above, the number of rolling mill stands has been decreased by multi-passing-through rolling where rolling is performed by repeating rolling within the limit in reducing amount of plate using rolling mills capable of reversely rolling.

In another case, a pushing apparatus and a pulling apparatus have been provided and rolling under high pressure has been performed by applying force to a slab to forcibly insert the slab between upper and lower working rollers using the pushing and pulling apparatus.

As described above, although a lot of efforts have been made to increase the limit in reducing amount of plate for engaging the front edge of a plate, the front edge portion and the rear edge portion of plate, which directly relate to the limit for engaging, have been cut out and thrown away as a non-steady state rolled portion, and only a middle portion of the plate has been usable as a plate product.

Further, the length of plate in rolling by hot working is short compared to that in rolling by cold working. Consequently improving the yield of products is difficult since the ratio occupied by the front and rear portions of the plate is comparatively large, and the rolling is not efficient.

To cope with the above noted problems, a continuous rolling by hot working is described in, for example, Japanese Patent Application Laid-Open No. 4-288207 (1992). In the continuous rolling by hot working, rolled base materials are continuously spliced together in advance of a rolling process and then rolled. In this technology, it is assumed that a conventional type rolling by hot working is performed using large scale rolling mills. It is not considered to improve the efficiency of rolling itself, and a large scale rolling system for manufacturing plate is required. Therefore, the technology is not suitable for a small scale rolling system for manufacturing plate.

Incidentally, in a case where rolling is performed once a plate is engaged in rollers, it is possible to further increase the thickness reducing amount of a plate. That is, in rolling after engaging a plate, there is no geometrical condition to limit the reducing amount of plate, and rolling can be performed as far as a condition of the neutral point within the roll-bite is employed. A substantial increase in the thickness reducing amount of a plate can be realized by utilizing this characteristic and by employing a base to roll after engaging a plate in rollers. In other words, it is possible to increase the thickness reducing amount of a plate by continuously splicing rolled base materials in advance of a rolling process, rolling the spliced rolled base materials, in which most part of the plates is rolled under a steady state condition, that is, under an after-engaged condition.

Further, it is recognized by the inventors that rolling by use of small diameter working rollers can be mechanically performed by rolling under an after-engaged condition. However, the rolling load and the rolling torque in rolling by hot working are large comparing to those in rolling by cold working. Therefore, in the past, it has been considered difficult to employ small scale rolling mills and small working rollers in rolling by hot-working. This problem is approached and solved by the present invention. Since the rolling load and the rolling torque are decreased when small diameter rollers are employed, problems of mechanical strength occur in a working roller neck portion with a directly driven working roller. Since the diameter of the neck portion should be structurally made smaller as the diameter of the working roller decreases, there is a resultant difficulty in directly driving the smaller working rollers.

Furthermore, it has been avoided in rolling by hot-working to employ indirect driving of working rollers where a reinforcing roller or intermediate roller is driven, since the rolling load and the rolling torque are large and slipping occurs between the rollers. However, in fact, since the rolling load and the rolling torque are decreased by decreasing the diameter of the working roller, the inventors recognize that this does not become any problem. Therefore, it is possible to realize a rolling mill for hot-working having small diameter rollers driven by supporting rollers in the form of a backup rollers or intermediate rollers.

Since rolling is performed with small diameter rollers, a small-sized rolling mill can be used.

Further, since rolling efficiency is improved, the number of rolling mill stands can be decreased and a small scale plant can be achieved.

Furthermore, since there is no need to forcibly insert a plate between an upper and a lower working rollers using a pushing apparatus and a pulling apparatus, complex rolling is not required.

According to the present invention, most portions of a rolled material can be rolled under an after-engaged rolling condition by use of a set of rolling mill stands having non-driven or indirectly driven small diameter working rollers by continuously splicing thin plates using a splicing machine, and small scale rolling mills can be used. Thereby, it can be attained to minimize the size of a system for manufacturing thin plate.

According to the present invention, the front edge portion of a thin plate is tapered using a front edge press to engage it between rollers when the thin plate is rolled in the first place, then the thin plate is rolled using a set of rolling mills having non-driven or indirectly driven small diameter working rollers. Thereby, it becomes easy to pass the first rolled thin plate through a rolling mill, and the thrown-away part of the non-steady rolled portion can be decreased. The thin plates following the first rolled thin plate are continuously spliced using a splicing machine and the thin plate can be rolled under an after-engaged rolling condition using a set of rolling mills having non-driven or indirectly driven small diameter working rollers, and thus small-sized rolling mills can be utilized. Thereby, it can be attained to minimize the size of a system for manufacturing thin plate.

According to preferred embodiments of the invention, in order to increase the limit in thickness reducing amount of plate for engaging the front edge of a plate, there are methods where the diameter of the working roller is increased and the thickness of plate is relatively decreased. In addition to these, a method to increase the friction coefficient between a roller and a plate to be rolled is also effective. When the friction coefficient is large, the force to draw a plate into the roller bite becomes large and consequently a large reducing amount of plate can be obtained.

According to the present invention, in rolling a plate to be rolled in the first place, rolling is performed using a set of rolling mills have non-driven small diameter working rollers by increasing the friction coefficient between the roller and the plate to make the engagement possible. Thereby, it becomes easy to pass the first rolled thin plate through a rolling mill, and thrown-away parts of non-steady rolled portions can be decreased. The thin plates following the first rolled thin plate are continuously spliced using a splicing machine to roll the thin plate under an after-engaged rolling condition using a set of rolling mills having non-driven small diameter rollers, and small-sized rolling mills can be utilized. Thereby, it can be attained to make the size of a system for manufacturing thin plate small.

The machine for increasing friction coefficient according to one embodiment is a machine to grind a working roller installed in a rolling mill, for example, a rotating grinding stone. Thereby, the friction coefficient between a roller and a plate to be rolled can be increased by increasing the surface roughness of the front edge of the plate.

The machine for increasing friction coefficient according to another embodiment is a machine for supplying friction increaser between a roller and a plate to be rolled. Thereby, the friction coefficient between a roller and a plate to be rolled can be increased by supplying small solid particles into the gap between the roller and the plate.

The splicing machine according to other preferred embodiments forms at least one indent portion on at least one of the surfaces of the rear edge of a precedent plate and the front edge of the following plate in superposing said plates, superposing and pressing the rear edge of said precedent plate and the front edge of said following plate, then sliding the rear edge of said precedent plate and the front edge of said following plate superposed and pressed against each other to join said precedent plate to said following plate. The method of superposing and sliding the plates has a function to strengthen the joint strength and improve reliability since sliding length can be lengthened. The method of forming at least one indent portion on at least one of the surfaces has a function to gather the oxide scale peeled off from the superposed surface by sliding and to promote joining. Thereby, splicing the rear edge of the precedent plate and the front edge of the following plate can be easily performed, and it can be attained to minimize the size of a system for manufacturing thin plate.

According to certain preferred embodiments, the method for splicing plates comprises the steps of thinning each of the rear edge of a precedent plate and the front edge of the following plate, and further during thinning the edges, forming at least one indent portion on at least one of the surfaces of the rear edge of said precedent plate and the front edge of said following plate to be superposed, superposing and pressing the rear edge of said precedent plate and the front edge of said following plate, then sliding the rear edge of said precedent plate and the front edge of said following plate superposed and pressed against each other to joint said precedent plate to said following plate. The method of thinning the thickness of the rear edge of the preceding plate and the front edge of the following plate has a function to prevent the spliced plate thickness after being spliced from increasing. Other functions are the same as described above.

Other objects, advantages and novel features of the present invention will become apparent from the following detailed description of the invention when considered in conjunction with the accompanying drawings.

DETAILED DESCRIPTION OF THE DRAWINGS

Figure 1:
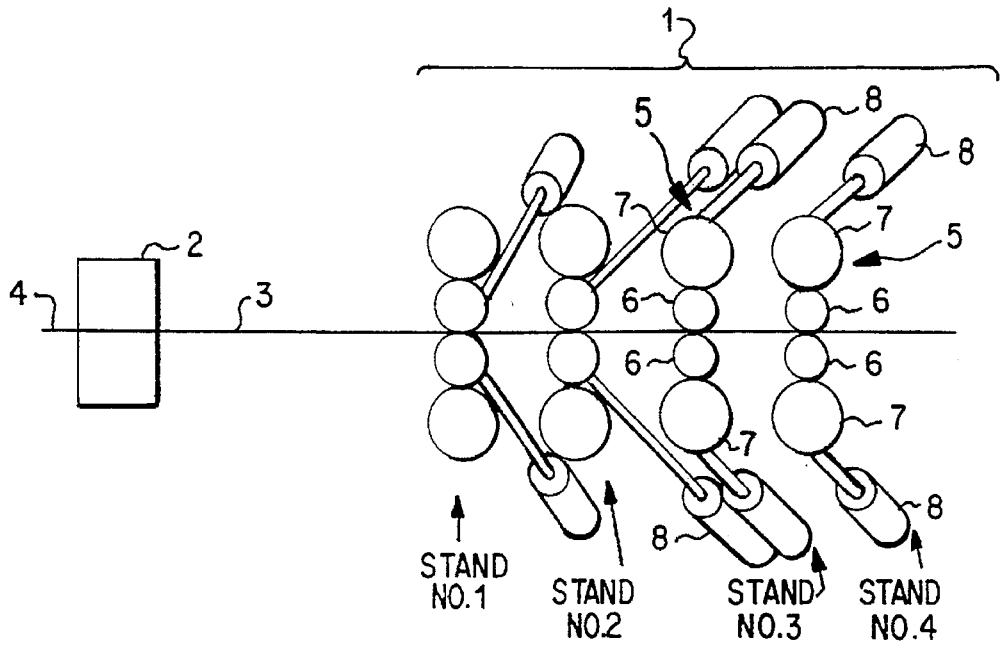
FIG. 1 is a schematic view showing a first embodiment of a system for manufacturing thin plate by hot working according to the present invention.

Throughout the drawing figures, similar reference numbers are used to designate similar features of the various illustrated preferred embodiments of the invention. In the following description, unless otherwise noted, the description of a feature illustrated in one drawing figure applies to the same numbered feature in the other drawing figures.

FIG. 1 shows a system for manufacturing thin plate by hot working according to the present invention which has a set of four rolling mill stands, the Stand Nos. 3 and 4 having non-driven or indirectly driven small diameter working rollers, and a splicing machine 2. The front edge of a following plate 4 and the rear edge of a precedent plate 3 are spliced in advance of a rolling process using the splicing machine 2, and the spliced together plates are fed continuously to the set of rolling mill 1. By continuously splicing the front edge of the following plate 4 and the rear edge of the precedent plate 3, most portions of the rolled plates can be rolled under a steady state rolling condition, that is, an after-engaged rolling condition, and the thickness reducing amount of the plate in most portions being rolled can be substantially increased, which improves the rolling efficiency.

Four-high rolling mill stands 5 having indirectly driven small diameter working rollers are installed in stand No. 3 and stand No. 4 in the set of rolling mill stands 1 of FIG. 1, reinforcing or back up rollers 7 being directly driven by driving motors 8. By driving the small diameter rollers 6 by the back up rollers 7, working roller neck portion strength problems, that would otherwise occur if rollers 6 were directly driven, are eliminated, and rolling with small diameter rollers can be realized. Stand No. 1 and Stand No. 2 of FIG. 1 include driven working rollers of larger diameter. Thereby, the diameter of the working rollers in the mill Stands No. 3 and No. 4 of FIG. 1 can be decreased according to preferred embodiments of the invention to substantially smaller than a diameter of 700–800 mm which is the diameter of working rollers used in conventional rolling mills. Consequently it can be realized according to the invention to make the four-high rolling mill stands 5 small and to attain a small-scale system for manufacturing thin plate by hot working.

In such a system for manufacturing thin plate by hot working as described above in connection with FIG. 1, by continuously splicing the front edge of the following plate and the rear edge of the precedent plate, most portions of the rolled plates can be rolled under steady state rolling conditions, that is an after-engaged rolling condition, and the thickness reducing amount of the plate in most portions thereof can be substantially increased, which improves the rolling efficiency. Thereby, the diameter of the working rollers at Stands No. 3 and No. 4 can be decreased smaller than the diameter of working rollers used in a conventional rolling mill, the rolling mill can be made small, and it can be realized to attain a small-scale system for manufacturing thin plate by hot working.

Figure 2:
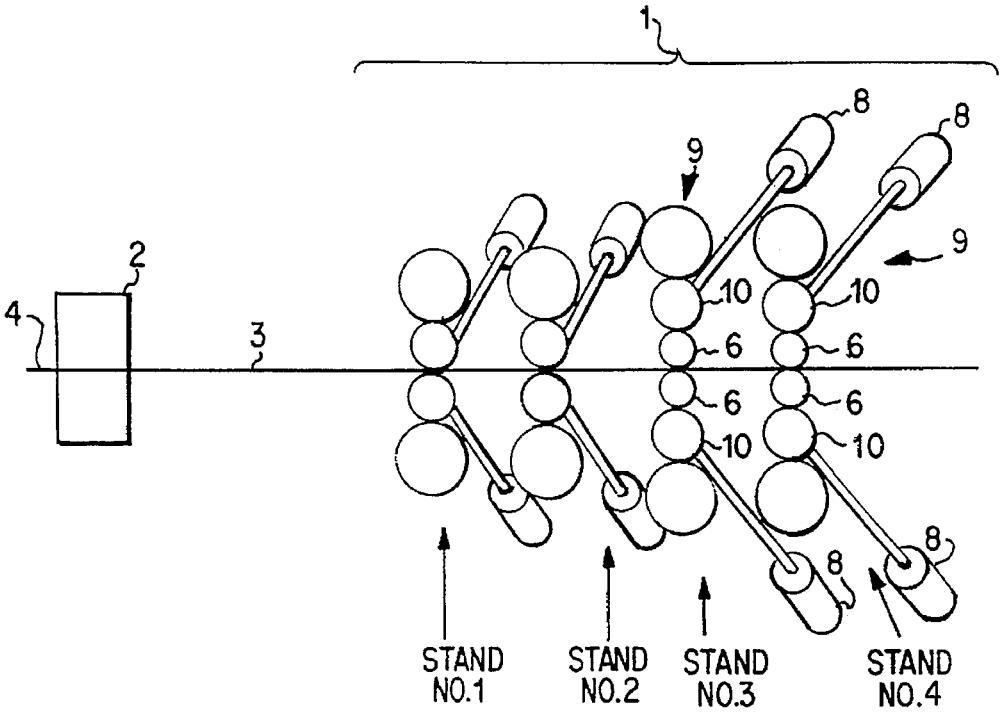
FIG. 2 is a schematic view showing a second embodiment of a system for manufacturing thin plate by hot working according to the present invention.

FIG. 2 shows a system for manufacturing thin plate by hot working according to the present invention which has sets of four rolling mill stands 1, Stands No. 3 and No. 4 having non-driven small diameter working rollers, and a splicing machine 2. The front edge of a following plate 4 and the rear edge of the precedent plate 3 are spliced in advance of a rolling process using the splicing machine 2, and the plates are fed to the set of rolling mill stands 1. By continuously splicing the front edge of the following plate 4 and the rear edge of the precedent plate 3, most portions of the rolled plates can be rolled under a steady state rolling condition, that is, an after-engaged rolling condition, and the thickness reducing amount of plate in most portions being rolled can be substantially increased, which improves the rolling efficiency.

In the FIG. 2 system, six-high rolling mill stands 9 having indirectly driven small diameter working rollers are installed in stand No.3 and stand No.4 in the set of rolling mill stands 1, intermediate rollers 10 being directly driven by driving motors 8. By driving the indirectly driven small diameter rollers 6 by the intermediate rollers 10, working roller neck portion strength problems, that would otherwise occur if the working rollers were directly driven, are eliminated, and rolling with small diameter rollers can be realized. Thereby, the diameter of the working rollers at Stands No. 3 and No. 4 can be decreased to substantially smaller than a diameter of 700–800 mm which is the diameter of working rollers used in a conventional rolling mill, and consequently it can be realized to make the six-high rolling mill stands 9 small and to attain a small-scale system for manufacturing thin plate by hot working. The first two mill stands of the FIG. 2 system have directly driven working rollers of a larger diameter than the Starts No. 3 and No. 4.

In such a system for manufacturing thin plate by hot working as described above in connection with FIG. 2, by continuously splicing the front edge of the following plate and the rear edge of the precedent plate, most portions of the rolled plates can be rolled under the steady state rolling condition, that is, the after-engaged rolling condition, and the thickness reducing amount of the plate in most portions of the rolled plate can be substantially increased, which improves the rolling efficiency. Thereby, the diameter of working rollers can be decreased smaller than the diameter of working rollers used in a conventional rolling mill, and it can be realized to make the rolling mill small and to attain a small-scale system for manufacturing thin plate by hot working.

Figure 3:
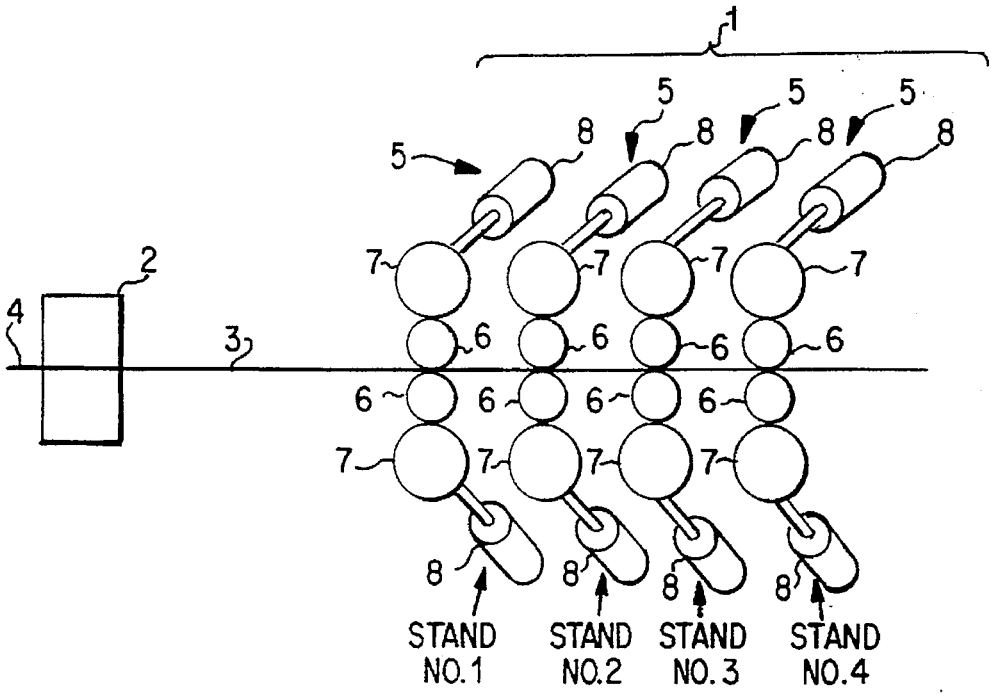
FIG. 3 is a schematic view showing a third embodiment of a system for manufacturing thin plate by hot working according to the present invention.

FIG. 3 shows a system for manufacturing thin plate by hot working according to the present invention which has a set of rolling mill stands 1 having indirectly driven small diameter working rollers 6 and a splicing machine 2. The front edge of a following plate 4 and the rear edge of the precedent plate 3 are spliced in advance of a rolling process using the splicing machine 2, and the plates are fed to the set of rolling mill stands 1. By continuously splicing the front edge of the following plate 4 end the rear edge of the precedent plate 3, most portions of the rolled plates can be rolled under a steady state rolling condition, that is, an after-engaged rolling condition, and the thickness reducing amount of the plate in most portions of the rolled plate can be substantially increased, which improves the rolling efficiency.

Four-high rolling mill stands 5 of FIG. 3 have indirectly driven small diameter working rollers 6 installed in all four stands, reinforcing or back up rollers 7 being directly driven by driving motors 8. By driving the indirectly driven small diameter rollers 6 by the reinforcing rollers 7, working roller neck portion strength problems are eliminated, and rolling with small diameter rollers can be realized. Thereby, the diameter of working roller can be decreased smaller than the diameter of 700–800 mm, which is the diameter of working rollers used in a conventional rolling mill, and consequently it can be realized to make the four-high rolling mill stands 5 small and to attain a small-scale system for manufacturing thin plate by hot working.

Figure 4:
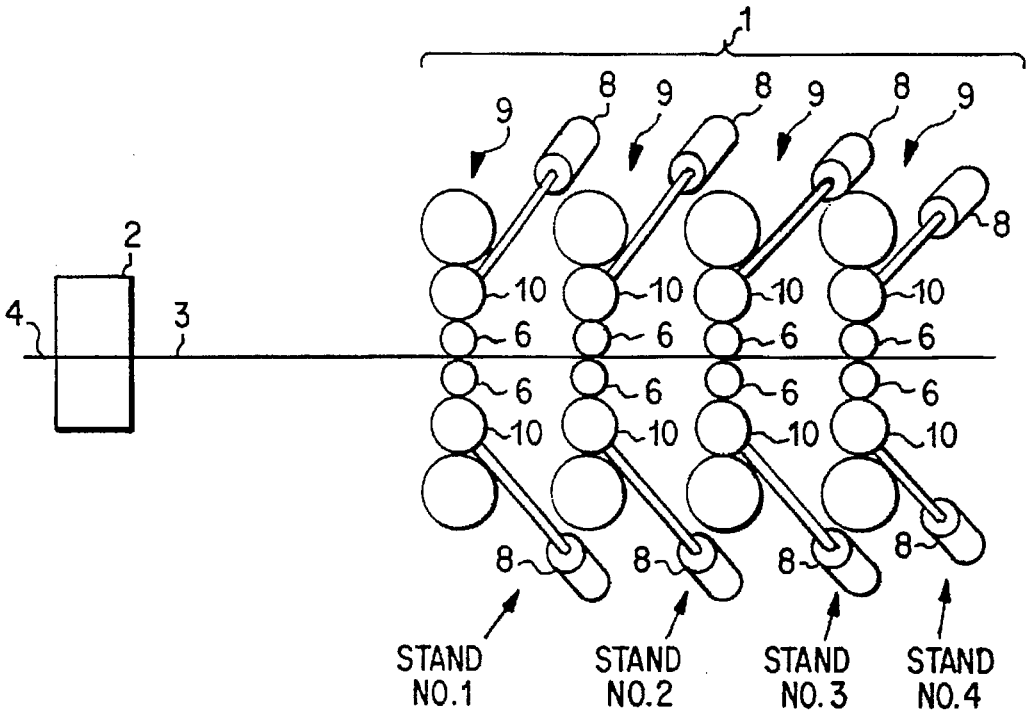
FIG. 4 is a schematic view showing a fourth embodiment of a system for manufacturing thin plate by hot working according to the present invention.

FIG. 4 shows a system for manufacturing thin plate by hot working according to the present invention which has a set of four rolling mill stands having indirectly driven small diameter working rollers 6 and a splicing machine 2. The plates are spliced in splicing machine 2 upstream of the rolling mill stands in the same manner and with the same advantages as described above for the systems of FIGS. 1–3.

Further, in the FIG. 4 embodiment, six-high rolling mills stands 9 having indirectly driven small diameter working rollers are installed in each of the four stands No. 1 to No. 4, intermediate rollers 10 being directly driven by driving motors 8. By driving the small diameter rollers 6 by way of the intermediate rollers 10, working roller neck portion strength problems are eliminated in a manner similar to that described above in conjunction with the embodiments of FIGS. 1–3. The advantages of using smaller working roller mill stands as described for the embodiments of FIGS. 1–3 also apply to the FIG. 4 arrangement.

As described in conjunction with FIG. 1 to FIG. 4, preferred embodiments of the present invention include various mill stand configurations with the small diameter working rollers and the directly driven supporting rollers may be either of the intermediate rollers (six-high, or six-high side stands) or the reinforcing rollers (four-high stands).

Figure 5:
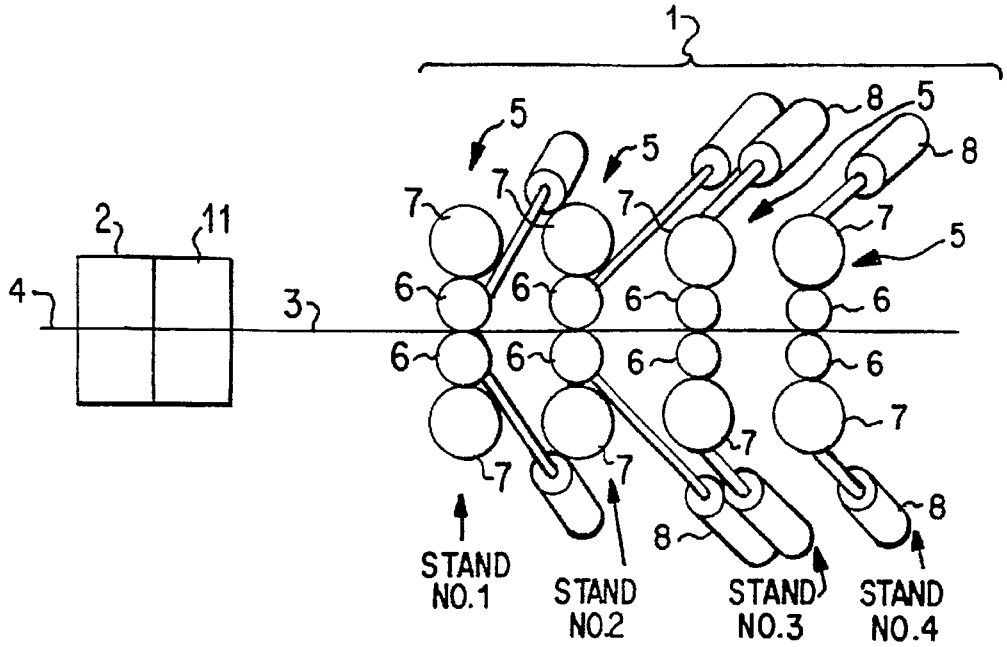
FIG. 5 is a schematic view showing a fifth embodiment of a system for manufacturing thin plate by hot working according to the present invention.

FIG. 5 shows a system for manufacturing thin plate by hot working according to the present invention which has a set of four rolling mill stands 1 and a splicing machine 2 and a front edge press 11. When initiating rolling of a plate, the front edge portion of the thin plate is tapered using the front edge press 11. Thereby, the limit in thickness reduction amount of the plate for engaging is effectively increased, and the first plate is easily passed through to be rolled.

The thin plates following the first rolled thin plate with the tapered front edge are fed to the set of rolling mills 1 by continuously splicing the front edge of the following plate 4 and the rear edge of the precedent plate 3 using the splicing machine 2, such as described above in conjunction with the other embodiments of FIGS. 1–4.

Further, of the four-high rolling mill stands 5 of FIG. 5, indirectly driven small diameter working rollers are installed in stand No. 3 and stand No. 4, reinforcing rollers 7 being directly driven by driving motors 8. By indirectly driving the working rollers 6 by the reinforcing rollers 70 the working roller neck portion strength problems are eliminated, and rolling with small diameter rollers can be realized. Thereby, as in other described embodiments, the diameter of the working rollers at Stands No. 3 and No. 4 can be decreased smaller than the diameter of 700–800 mm which is the diameter of working rollers used in conventional rolling mills, and consequently it can be realized to make the four-high rolling mills 5 small and to attain a small-scale system for manufacturing thin plate by hot working.

The FIG. 5 embodiment provides the above described advantages of the other embodiments, and the provision of the front edge press 11 facilitates start up of rolling (biting of the plate by the working rollers) with a thicker plate, yet further enhancing the rolling operation and facilitating a smaller overall manufacturing system.

Figure 6:
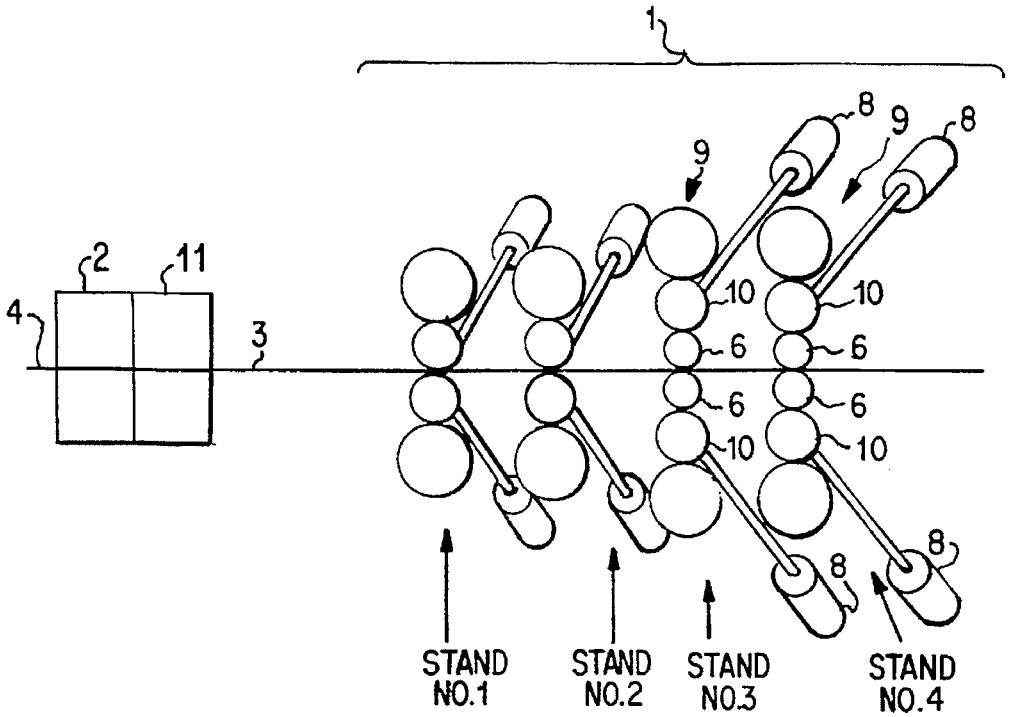
FIG. 6 is a schematic view showing a sixth embodiment of a system for manufacturing thin plate by hot working according to the present invention.

FIG. 6 shows a system for manufacturing thin plate by hot working according to the present invention which has a set of four rolling mill stands 1, splicing machine 2 and a front edge press 11. Six-high rolling mill stands 9 having non-driven small diameter working rollers are installed in stand No. 3 and No. 4, intermediate rollers 10 being directly driven by driving motors 8. This FIG. 6 system is similar to the system of FIG. 2, with the addition of the front edge press such a described above in conjunction with FIG. 5.

Figure 7:
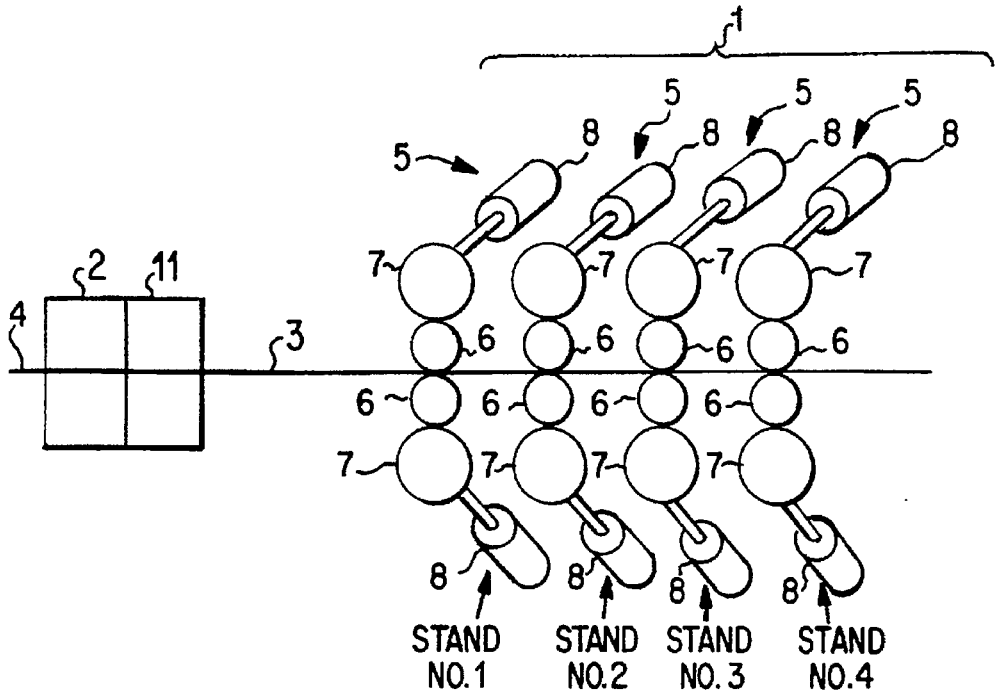
FIG. 7 is a schematic view showing a seventh embodiment of a system for manufacturing thin plate by hot working according to the present invention.

FIG. 7 shows a system for manufacturing thin plate by hot working according to the present invention which has a set of four rolling mill stands having non-driven small diameter working rollers 1, a splicing machine 2 and a front edge press 11. Four-high rolling mill stands 5 having non-driving small diameter working rollers are installed in all four stands No. 1 to No. 4, reinforcing rollers 7 being directly driven by driving motors 8. This system is similar to the system of FIG. 3, with the addition of a front edge press 11 as generally described in conjunction with FIG. 5.

Figure 8:
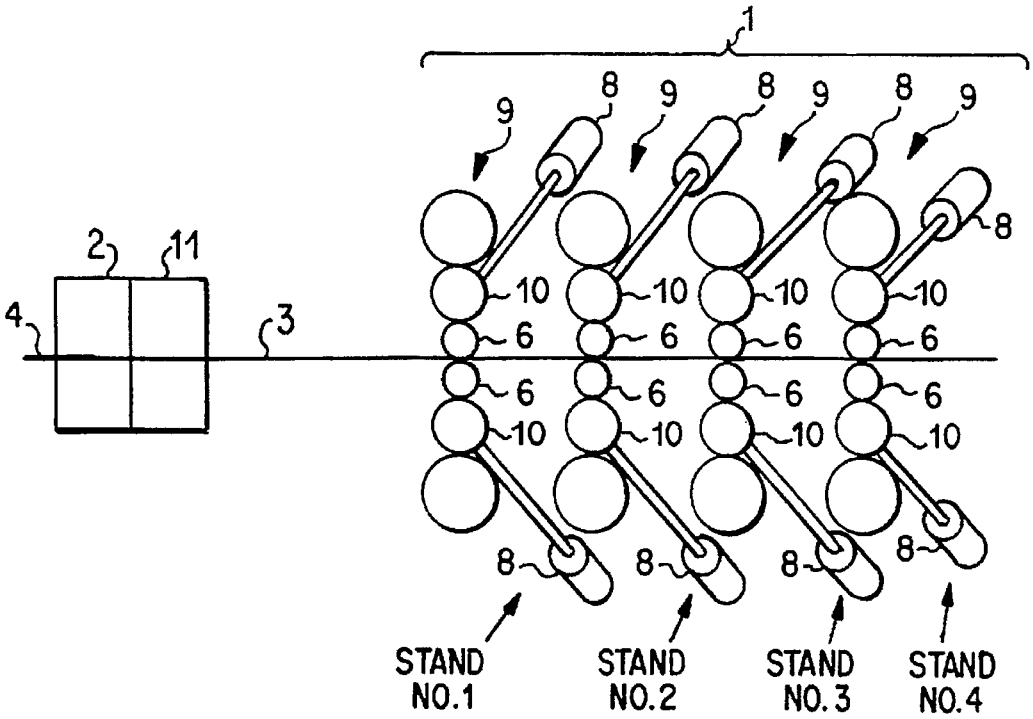
FIG. 8 is a schematic view showing an eighth embodiment of a system for manufacturing thin plate by hot working according to the present invention.

FIG. 8 shows a system for manufacturing thin plate by hot working according to the present invention which has a set of four rolling mill stands 1 having non-driven small diameter working rollers 6, a splicing machine 2 and a front edge press 11. Six-high rolling mill stands 9 having non-driven small diameter working rollers 6 are installed in all four stands No. 1 to No. 4, intermediate rollers 10 being directly driven by driving motors 8. This system is similar to the system of FIG. 4, with the addition of a front edge press 11 as generally described in conjunction with FIG. 5.

The systems of FIGS. 5–8 exhibit the advantages described above for the embodiment of FIGS. 1–4, as well as the advantages for initiating rolling of a first plate by use the front edge press 11.

Figure 9A:
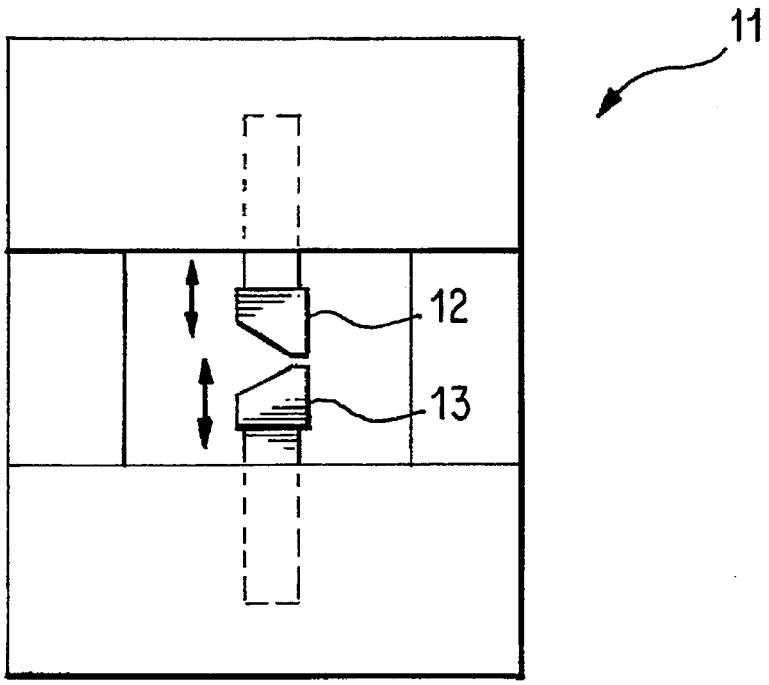
FIG. 9A is a schematic view showing a first embodiment of a front edge press in a system for manufacturing thin plate by hot working according to the present invention.
Figure 9B:
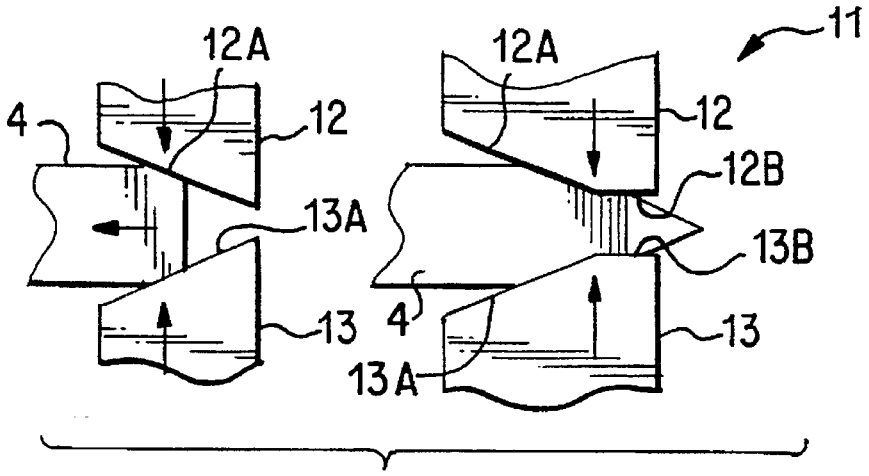
FIG. 9B is a schematic view depicting operation of the front edge press of FIG. 9B.

FIGS. 9A AND 9B show details of a first embodiment of a front edge press for use as the edge press 11 in the embodiments according to the present invention illustrated in FIG. 5 to FIG. 8.

Referring to FIGS. 9A and 9B, taper portions 12A, 13A and parallel portions 12B, 13B are provided in anvil blocks 12 and 13 for continuously tapering the front edge portion of a thin plate 4. Although the thickness of the front edge portion of the plate 4 is reduced by pushing the anvil blocks 12 and 13 from upward and downward to the plate 3, the taper portions should be provided in the anvil blocks 12 and 13 to form the front edge so as to continuously decrease its thickness. When the anvil blocks 12 and 13 are pushed from upward and downward toward the plate 4, as shown in FIG. 9B (left side), the taper portions 12A and 13A act with a force on the front portion of the plate to push it back, and the position and the shape of the front edge of the plate are changed. Therefore, the function of the front edge press cannot be displayed sufficiently.

When the taper portions 12A, 13A and parallel portions 12B, 13B are both provided in the anvil blocks 12 and 13 (FIG. 9B, right side), the parallel portions 12B, 13B contact and grip the plate in the first place and concurrently press the plate to prevent the plate 4 from moving. Then, although the taper portions push down the plate and act with a force on the plate to push back, the parallel portions 12B, 13B further push down the plate 4 to prevent the plate 4 from moving. Therefore, the position of the front edge portion is fixed. By doing this, unstable moving of the position of the front edge and unstable change of the shape of the front edge can be prevented and the function of the front edge press can be displayed sufficiently. Thereby, a plate 4 rolled in the first place can be easily passed through the first set of rolling mill working rollers, rolling can be performed using a set of rolling mill stands having small diameter working rollers, and consequently it can be realized to make the rolling mill small in size and to attain a small-scale system for manufacturing thin plate by hot working.

Figure 10A:
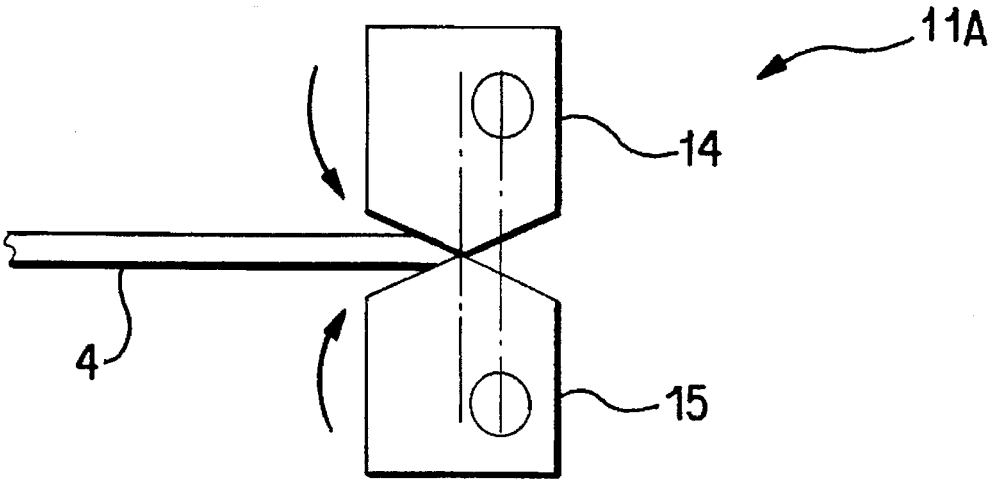
FIG. 10A is a schematic view showing a second embodiment of a front edge press in a system for manufacturing thin plate by hot working according to the present invention.
Figure 10B:
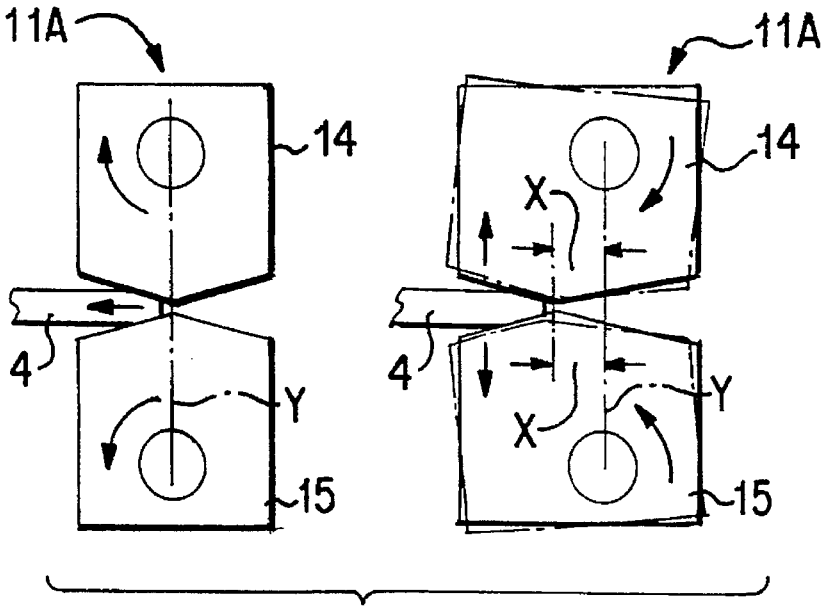
FIG. 10B is a schematic view depicting operation of the front edge press of FIG. 10A.

FIGS. 10A and 10B show details of a second embodiment of a front edge press 11A, for use as the press 11 in the embodiments according to the present invention described in FIG. 5 to FIG. 8. In order to continuously taper the front edge portion of a thin plate 4, the front edge press comprises rotatable upper and lower anvil blocks 14 and 15, an off-set "X" being provided between the line Y connecting between the upper and the lower rotating centers of the anvil blocks 14 and 15 and the minimum bite gap portion between the upper and the lower anvil blocks 14 and 15. The front edge portion is continuously tapered by rotating and pushing down the upper and lower anvil blocks 14 and 15 toward the plate 4. Although the plate 4 is released by rotating the upper and lower anvil blocks 14 and 15 in the reverse direction after tapering the front edge of the plate 4, as shown in FIG. 10B, the upper and lower anvil blocks 14 and 15 act with a push back force on the front edge portion to push back the plate 4. Thereby, the position and the shape of the front edge of the plate are changed, and the function of the front edge press cannot be displayed sufficiently. To avoid this, it is provided that the upper and lower anvil blocks 14 and 15 detach from the plate 4 at the same time when the plate 4 is released with rotation of the upper and lower anvil blocks 14 and 15 in the reverse direction. By providing an off-set X between the line Y connecting between the upper and the lower rotating centers of the upper and the lower anvil blocks 14 and 15 and the minimum bite gap portion between the upper and the lower anvil blocks 14 and 15, it is possible that the upper and lower anvil blocks 14 and 15 detach from the plate 4 at the same time. By doing this, unstable moving of the position of the front edge and unstable change of the shape of the front edge can be prevented and the function of the front edge press can be displayed sufficiently. Thereby, a plate rolled in the first place can be easily passed through, rolling can be performed using a set of rolling mills having small diameter working rollers, the rolling mills can be made small in size, and a small-scale system for manufacturing thin plate by hot working can be obtained.

The front edge press of FIGS. 9A, 9B, 10A and 10B may be mounted for movement along the travel path of the thin plate being treated.

Figure 11A:
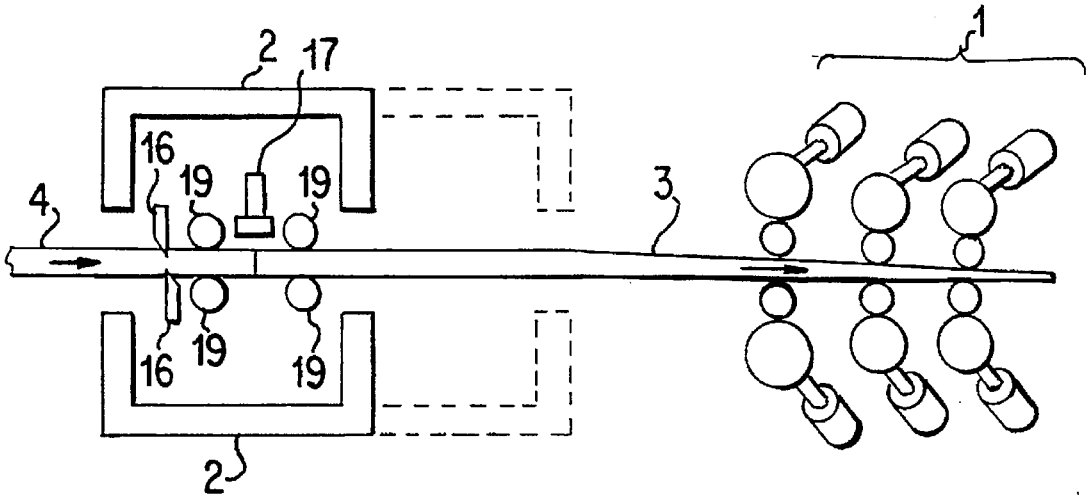
FIG. 11A is a schematic view showing a first embodiment of a splicing machine in a system for manufacturing thin plate by hot working according to the present invention.
Figure 11B:
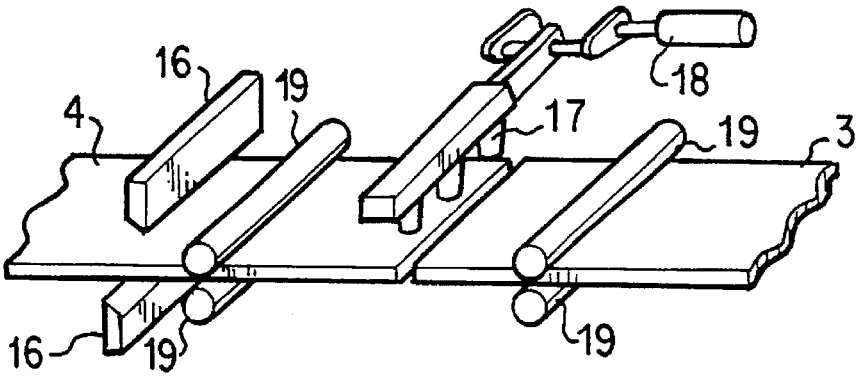
FIG. 11B is a schematic enlarged view depicting operation of the splicing machine of the system of FIG. 11A.

FIGS. 11A and 11B show details of a first embodiment of a splicing machine 2 for splicing the rear edge of the precedent plate 3 and the front edge of the following plate 4 in the embodiments according to the present invention described in FIG. 1 to FIG. 8. This splicing machine and the other embodiments of splicing machines described herein are mounted so as to be sequentially movable along the travel path of the plates being spliced (see dash line representation in FIG. 11) and then returned to carry out another splicing operation, without interrupting the travel of the plates. U.S. Pat. Nos. 5,121,873 and 5,324,154 relate to moving splicing systems.

The splicing machine 2 of FIGS. 11A and 11B comprises a cutting machine 16 for cutting the rear edge of the precedent plate 3 and the front edge of the following plate 4 nearly perpendicular to the rolling direction. A plurality of melt-planing torches 17 are arranged in the width direction of the plate 4. A transferring crank mechanism 18 is provided for transferring the melt-planning torches 17 in the width direction of the plate. Pinch rollers 19 are provided for applying pressing force to the interface of the rear edge of the precedent plate and the front edge of the following plate. The rear edge of the precedent plate 3 and the front edge of the following plate 4 are cut nearly perpendicular to the rolling direction by the cutting machine 16. At least one of the rear edge of the precedent plate 3 and the front edge of the following plate 4 is melt-planed by blowing jet flow of the melt-planing torches 17 to a portion with a given width from the edge, the melt-planning torches 17 being transferred and melting the rolled plate in the width direction of the rolled plate using the transferring crank mechanism 18 to form a splicing surface nearly perpendicular to the rolling direction on the edge surface by melt-planning. The splicing surface can be made comparatively small. Since the splicing surfaces are sufficiently heated by the jet flow of the melt-planing torches 17 at this time, it is easy to splice the thin plates by applying pressing force to the splicing surfaces. The two plates can be spliced by applying pressing force on the splicing surfaces in the rolling direction using the pinch roller 19.

Figure 12A:
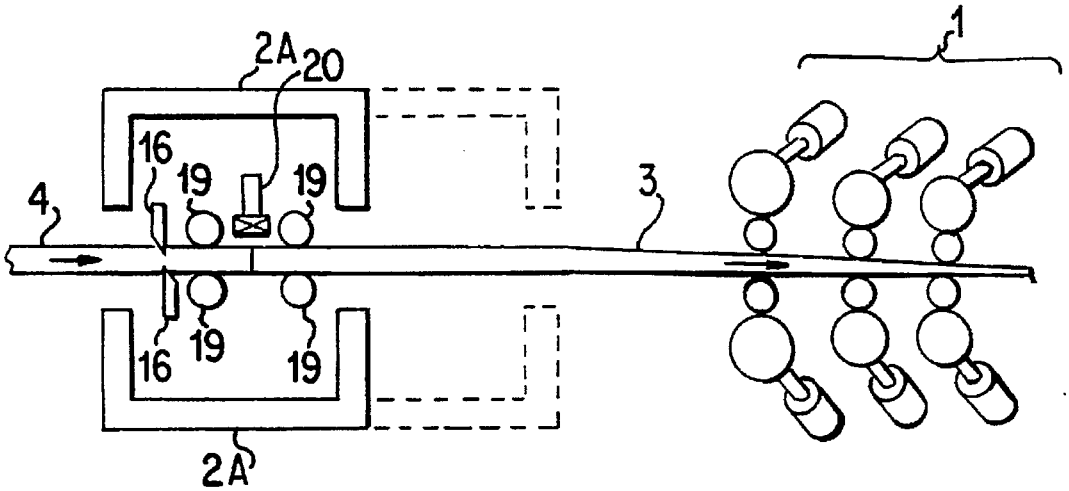
FIG. 12A is a schematic view showing a second embodiment of a splicing machine in a system for manufacturing thin plate by hot working according to the present invention.
Figure 12B:
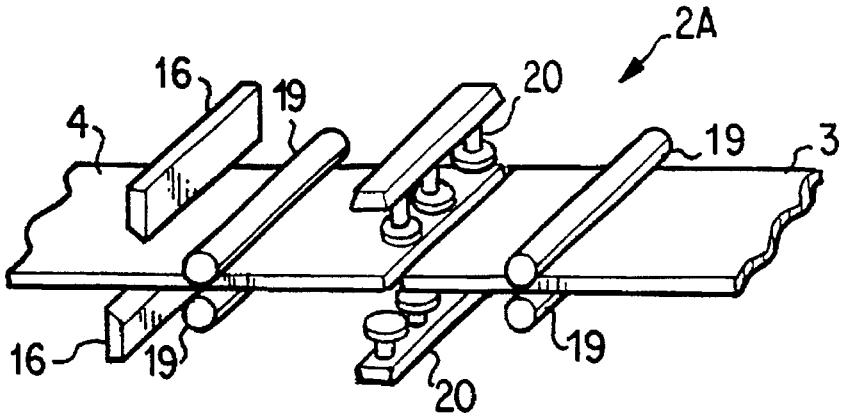
FIG. 12B is a schematic enlarged view depicting operation of the splicing machine of the system of FIG. 12A.

FIGS. 12A AND 12B show details of a second embodiment of a splicing machine 2A for splicing the rear edge of the precedent plate 3 and the front edge of the following plate 4 in the embodiments according to the present invention described in FIG. 1 to FIG. 8.

The splicing machine 2A comprises a cutting machine 16 for cutting the rear edge of the precedent plate 3 and the front edge of the following plate 4 nearly perpendicular to the rolling direction, an induction heating coil unit 20 placed facing upper and lower surfaces of the plate, and pinch rollers 19 for applying pressing force to the interface of the rear edge of the precedent plate and the front edge of the following plate. The rear edge of the precedent plate 3 and the front edge of the following plate 4 are cut nearly perpendicular to the rolling direction by the cutting machine 16. The rear edge of the precedent plate 3 and the front edge of the following plate 4 are butted with a gap therebetween, and the butted surfaces of the plates are heated using the induction heating coil unit 20. Since the splicing surfaces are sufficiently heated by the induction heating coil unit 20 at this time, it is easy to splice the thin plates by applying pressing force to the splicing surfaces.

Figure 13A:
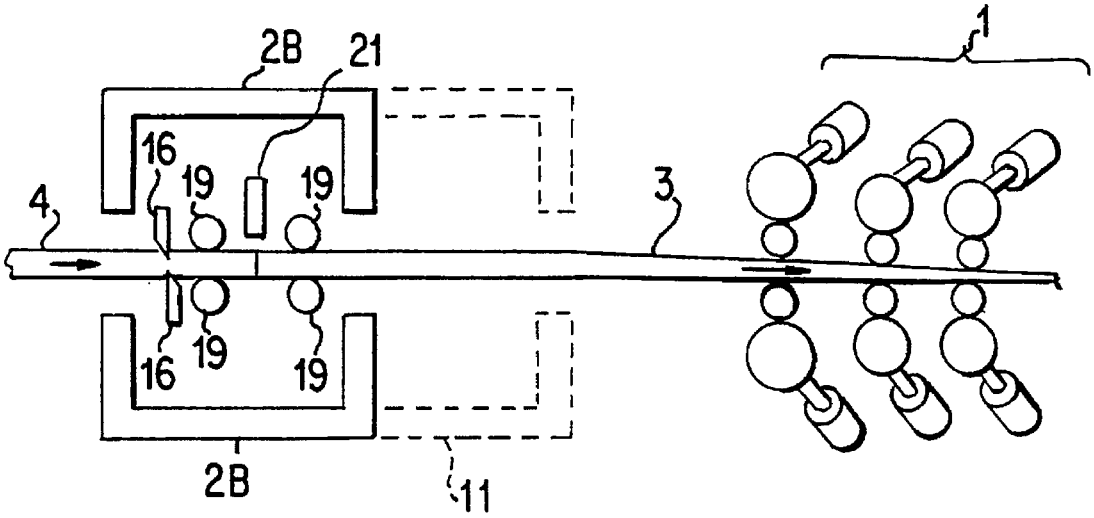
FIG. 13A is a schematic view showing a third embodiment of a splicing machine in a system for manufacturing thin plate by hot working according to the present invention.
Figure 13B:
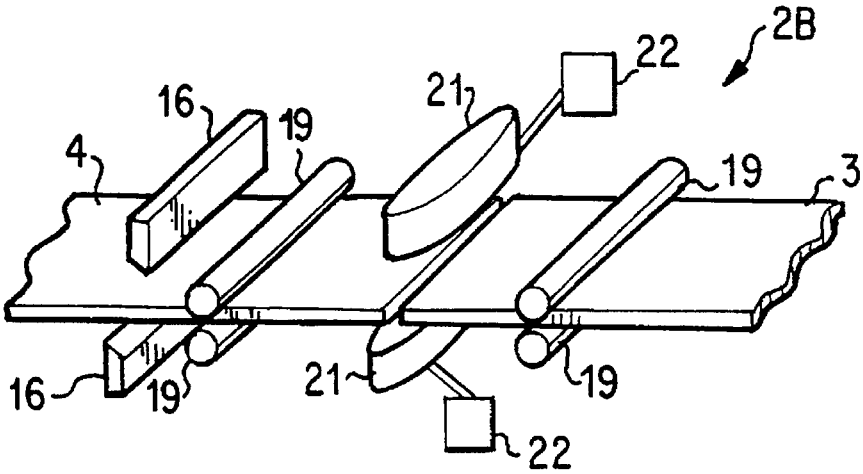
FIG. 13B is a schematic enlarged view depicting operation of the splicing machine of the system of FIG. 13A.

FIGS. 13A and 13B show details of a third embodiment of a splicing machine 2B for splicing the rear edge of the precedent plate 3 and the front edge of the following plate 4 in the embodiments according to the present invention described in FIG. 1 to FIG. 8.

The splicing machine 2B comprises a cutting machine 16 for cutting the rear edge of the precedent plate 3 and the front edge of the following plate 4 nearly perpendicular to the rolling direction, an arc generating unit 21 for locally generating arc by conducting direct current in the gap between the butted surfaces of the plates, an arc transferring machine 22 for moving the arc generating unit 21 in the width direction of the plate, and pinch rollers 19 for applying pressing force to the interface of the rear edge of the precedent plate and the front edge of the following plate. The rear edge of the precedent plate 3 and the front edge of the following plate 4 are cut nearly perpendicular to the rolling direction by the cutting machine 16. The rear edge of the precedent plate 3 and the front edge of the following plate 4 are butted with a gap between the rear edge of the precedent thin plate 3 and the front edge of the following thin plate 4, direct current being conducted in the gap to locally generate arc by using the arc generating unit 21 and concurrently applying alternating magnetic field in the thickness direction of the gap to apply a magnetic force in the width direction to the arc by using the arc transferring mechanism 22 to heat-melt the edge surfaces of the plates by the arc moving in the width direction of the plates. Since the splicing surfaces are sufficiently heated by the arc at this time, it is easy to splice the thin plates by applying pressing force to the splicing surfaces. The two plates can be spliced by applying pressing force on the splicing surfaces in the rolling direction using the pinch roller 19.

Figure 14A:
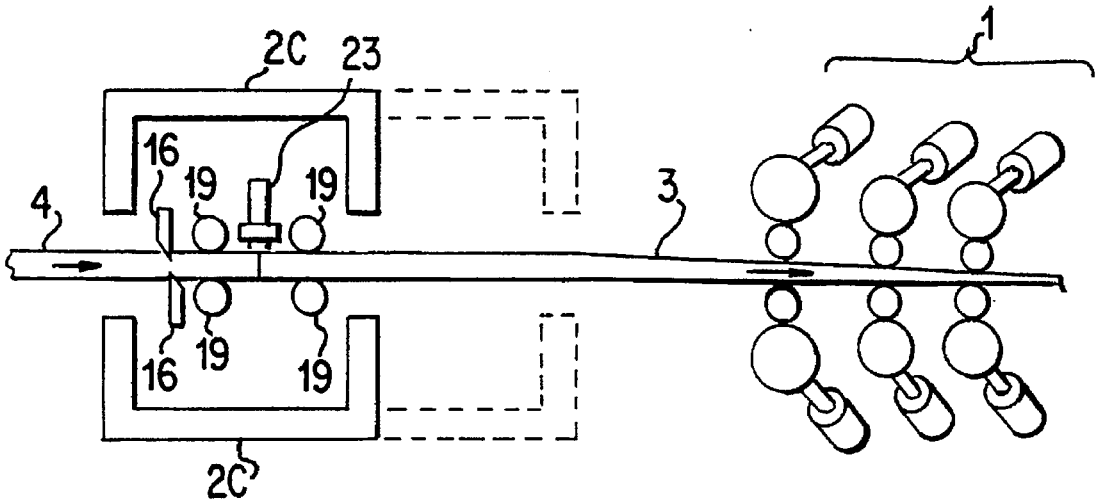
FIG. 14A is a schematic view showing a fourth embodiment of a splicing machine in a system for manufacturing thin plate by hot working according to the present invention.
Figure 14B:
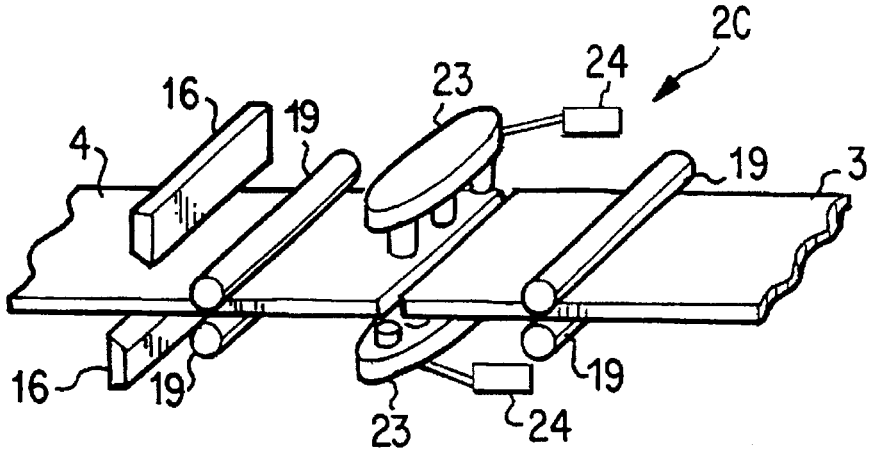
FIG. 14B is a schematic enlarged view depicting operation of the splicing machine of the system of FIG. 14A.

FIGS. 14A and 14B show details of a fourth embodiment of a splicing machine 2C for splicing the rear edge of the precedent plate 3 and the front edge of the following plate 4 in the embodiments according to the present invention described in FIG. 1 to FIG. 8.

The splicing machine 2C comprises a cutting machine 16 for cutting the rear edge of the precedent plate 3 and the front edge of the following plate 4 nearly perpendicular to the rolling direction, an oxygen gas jetting unit 23 capable of jetting the gas in the width direction of the edge of the plate, an iron powder mixing unit 24 for mixing iron powder into the oxygen gas, and pinch rollers 19 for applying pressing force to the interface of the rear edge of the precedent plate and the front edge of the following plate. The rear edge of the precedent plate 3 and the front edge of the following plate 4 are cut nearly perpendicular to the rolling direction by the cutting machine 16. At least one of the rear edge of the precedent plate 3 and the front edge of the following plate 4 is heated and melted by blowing oxygen gas onto at least one of the edge surfaces using the oxygen gas jetting unit 23. At this time, iron powder is mixed into the oxygen gas by the iron powder mixing unit 24 if necessary. Thereby, since the splicing surfaces are sufficiently heated as well as oxidized scales are blown away, it is easy to splice the thin plates by applying pressing force to the splicing surfaces. The both plates can be spliced by applying pressing force by way of rollers 19.

Figure 15A:
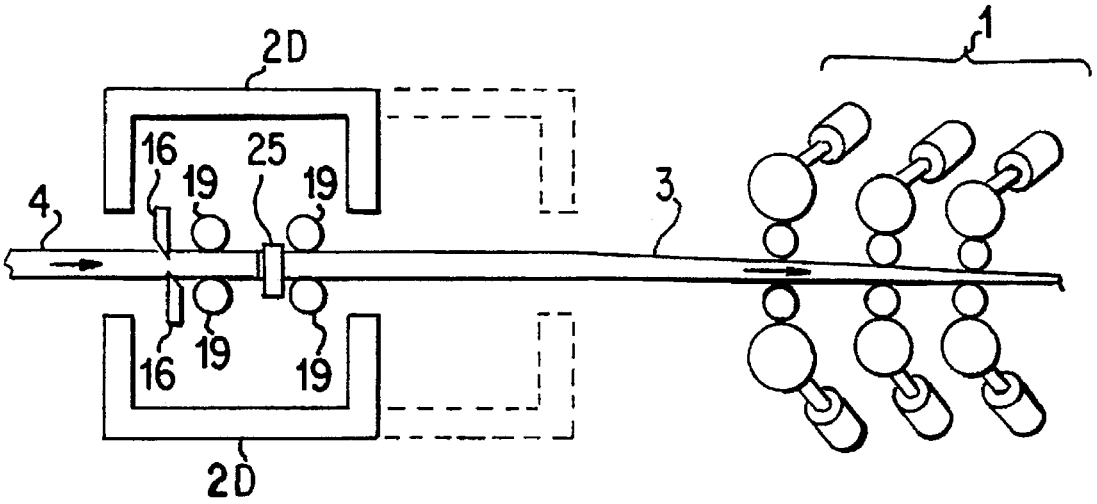
FIG. 15A is a schematic view showing a fifth embodiment of a splicing machine in a system for manufacturing thin plate by hot working according to the present invention.
Figure 15B:
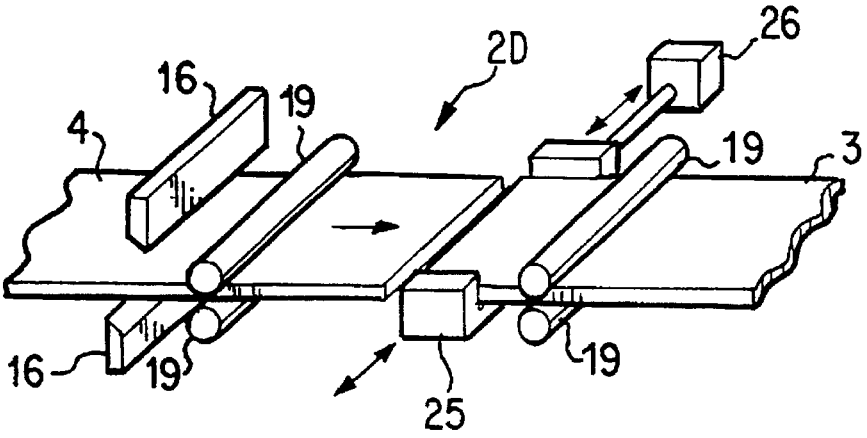
FIG. 15B is a schematic enlarged view depicting operation of the splicing machine of the system of FIG. 15A.

FIGS. 15A and 15B show details of a fifth embodiment of a splicing machine 2D for splicing the rear edge of the precedent plate 3 and the front edge of the following plate 4 in the embodiments according to the present invention described in FIG. 1 to FIG. 8.

The splicing machine 2D comprises a cutting machine 16 for cutting the rear edge of the precedent plate 3 and the front edge of the following plate 4 nearly perpendicular to the rolling direction, a movable holding mechanism 25 capable of moving with holding of the plate in the width direction of the plate, vibrator 26 for vibrating the movable holding mechanism 25 in the width direction of the plate, and pinch rollers 19 for applying pressing force to the interface of the rear edge of the precedent plate and the front edge of the following plate. The rear edge of the precedent plate 3 and the front edge of the following plate 4 are cut nearly perpendicular to the rolling direction by the cutting machine 16. At least one of the rear edge of the precedent plate 3 and the front edge of the following plate 4 is vibrated and pressed to each other by the vibrator 31 and the movable holding mechanism 25. Since thereby the splicing surfaces are sufficiently heated and oxidized scales are blown away, it is easy to splice the plates by applying pressing force to the splicing surfaces. The both plates can be spliced by applying pressing force, by way of the rollers 19.

Figure 16A:
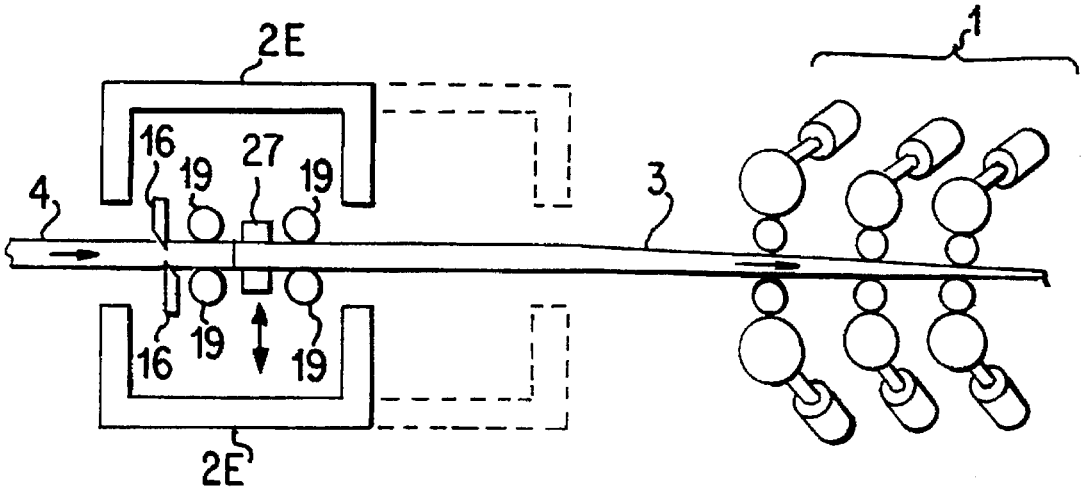
FIG. 16A is a schematic view showing a sixth embodiment of a splicing machine in a system for manufacturing thin plate by hot working according to the present invention.
Figure 16B:
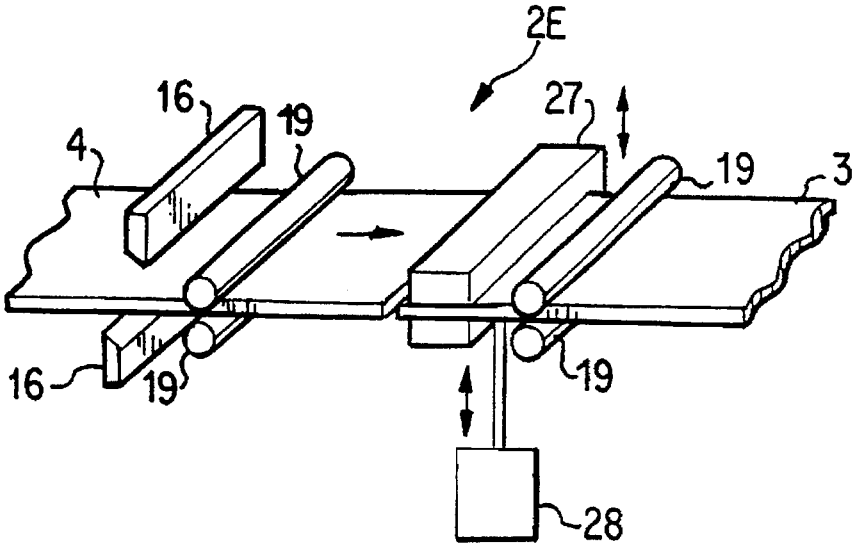
FIG. 16B is a schematic enlarged view depicting operation of the splicing machine of the system of FIG. 16A.

FIGS. 16A and 16B show details of a sixth embodiment of a splicing machine 2E for splicing the rear edge of the precedent plate 3 and the front edge of the following plate 4 in the embodiments according to the present invention described in FIG. 1 to FIG. 8.

The splicing machine 2E comprises a cutting machine 16 for cutting the rear edge of the precedent plate 3 and the front edge of the following plate 4 nearly perpendicular to the rolling direction, a movable holding mechanism 27 capable of moving while holding the plate in the thickness direction of the plate, vibrator 28 for vibrating the movable holding mechanism 27 in the thickness direction of the plate, and pinch rollers 19 for applying pressing force to the interface of the rear edge of the precedent plate 3 and the front edge of the following plate 4. The rear edge of the precedent plate 3 and the front edge of the following plate 4 are cut nearly perpendicular to the rolling direction by the cutting machine 16. At least one of the rear edge of the precedent plate 3 and the front edge of the following plate 4 is vibrated and pressed to each other by the vibrator 28 and the movable holding mechanism 27. Since thereby the splicing surfaces are sufficiently heated and oxidized scales are blown away, it is easy to splice the plates by applying pressing force to the splicing surfaces using roller 19. The two plates can be spliced by applying pressing force.

According to the present invention, by continuously splicing the front edge of the following plate and the rear edge of the precedent plate using a splicing machine, most portions of the rolled plates can be rolled under the steady state rolling condition, that is, the after-engaged rolling condition, and the thickness reducing amount of the plates in most portions of the rolled material can be substantially increased, which improves the rolling efficiency, and, in addition to this, the plate rolled in the first place can be easily passed through using the front edge press. Thereby, the diameter of the working rollers can be decreased smaller than the diameter of working rollers used in a conventional rolling mill, the rolling mill stands can be made smaller, and it can be realized to attain a small-scale system for manufacturing thin plate by hot working.

Figure 17:
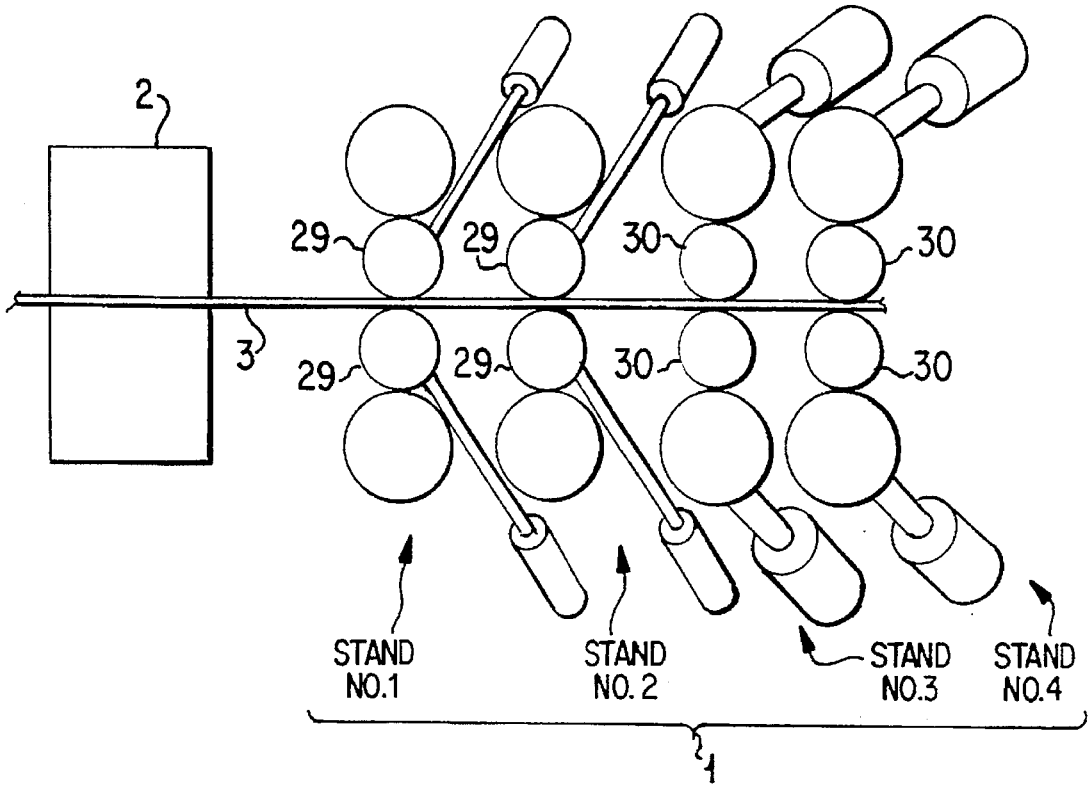
FIG. 17 is a schematic view showing a ninth embodiment of a system for manufacturing thin plate by hot working according to the present invention.

FIG. 17 is a schematic view showing a further embodiment according to the present invention. In a system for manufacturing thin plate by hot working having a set of rolling mill stands 1 and a splicing machine 2, the set of rolling mill stands 1 placed in the process following the splicing machine 2 are constructed such that at least a first front rolling mill or first and second front rolling mills have working rollers 29 made of a material for high temperature and the other rolling mills have working rollers 30 made of a material for low temperature, the materials for the working rollers being different from each other. This system also exhibits the advantages and features of other embodiments such as the embodiment of FIG. 1. This embodiment reflects the recognition that it is important to maintain the temperature of the thin plate, since the temperature easily decreases in the rolling process. Although it is possible to prevent temperature drop in the plate by raising the temperature of the plate using a warming furnace, heat cracks are apt to occur on the surface of working rollers due to raised temperatures of the plate and the plate quality may be degraded. It is provided in this embodiment to roll a high temperature plate by employing working rollers 29 made of a material for high temperature such as a material having high heat crack resistivity, for example, special casting steel, high nickel casting steel and so on, in at least a first front rolling mill or in the first and second front rolling mills. In the other rolling mills where the temperature of the plate is decreased, employed as the working rollers 30 for low temperature is a material having high roughness resistivity and high abrasion resistivity such as, for example, adamant steel, nickel-grain steel, high nickel steel and so on. Thereby, the life of the working rollers is increased and more economical rolling can be attained.

Figure 18:
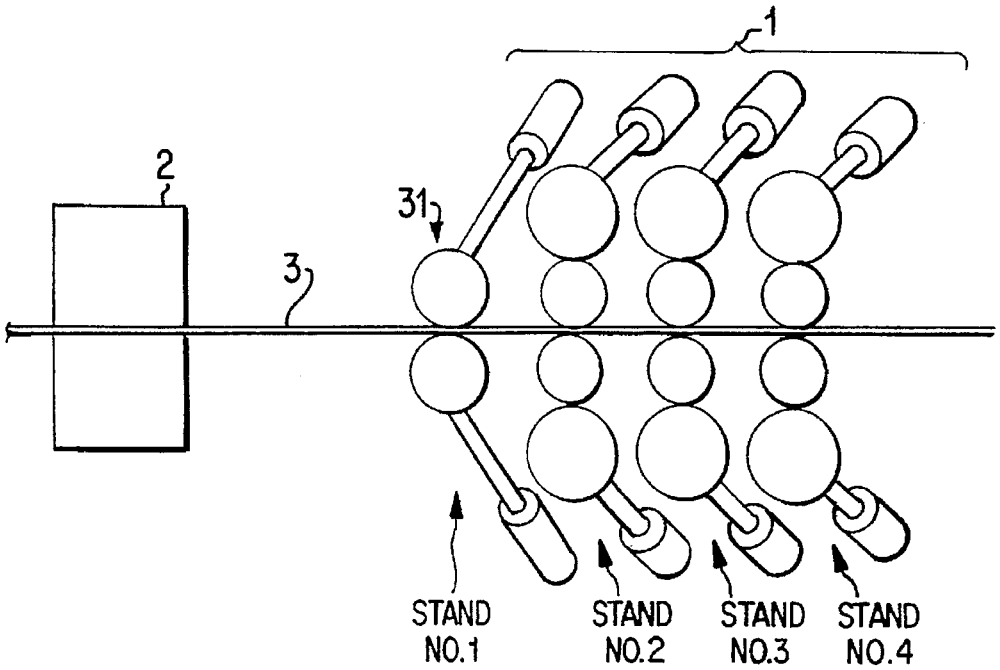
FIG. 18 is a schematic view showing a tenth embodiment of a system for manufacturing thin plate by hot working according to the present invention.

FIG. 18 is a schematic view showing a further embodiment according to the present invention. In a system for manufacturing thin plate by hot working having a set of rolling mill stands 1 and a splicing machine 2, the set of rolling mill stands 1 placed in the process following the splicing machine 2 are constructed such that at least a first front rolling mill stand or the first and second front rolling mill stands are two-high rolling mill stand(s) 31 and the other rolling mill stands are four-high rolling mill stand having indirectly driven small diameter working rollers. This system also exhibits the advantages and features described for other embodiments due to the continuous splicing upstream of mills with small working rolls. In order to make the rolling mill further smaller, although it is preferable to employ the two-high rolling mill stand 31, it is difficult to manufacture high quality plate only using two-high rolling mill stands 31 because of low control capability for plate crown and plate shape. However, the effect of plate crown and plate shape is inherently larger in rear stages of rolling and smaller in front stages of rolling. Therefore, the rolling mill can be made small by employing the two-high rolling mills 31 at least for the first front rolling mill or the first and second front rolling mills according to the embodiment of FIG. 18.

Figure 19A:
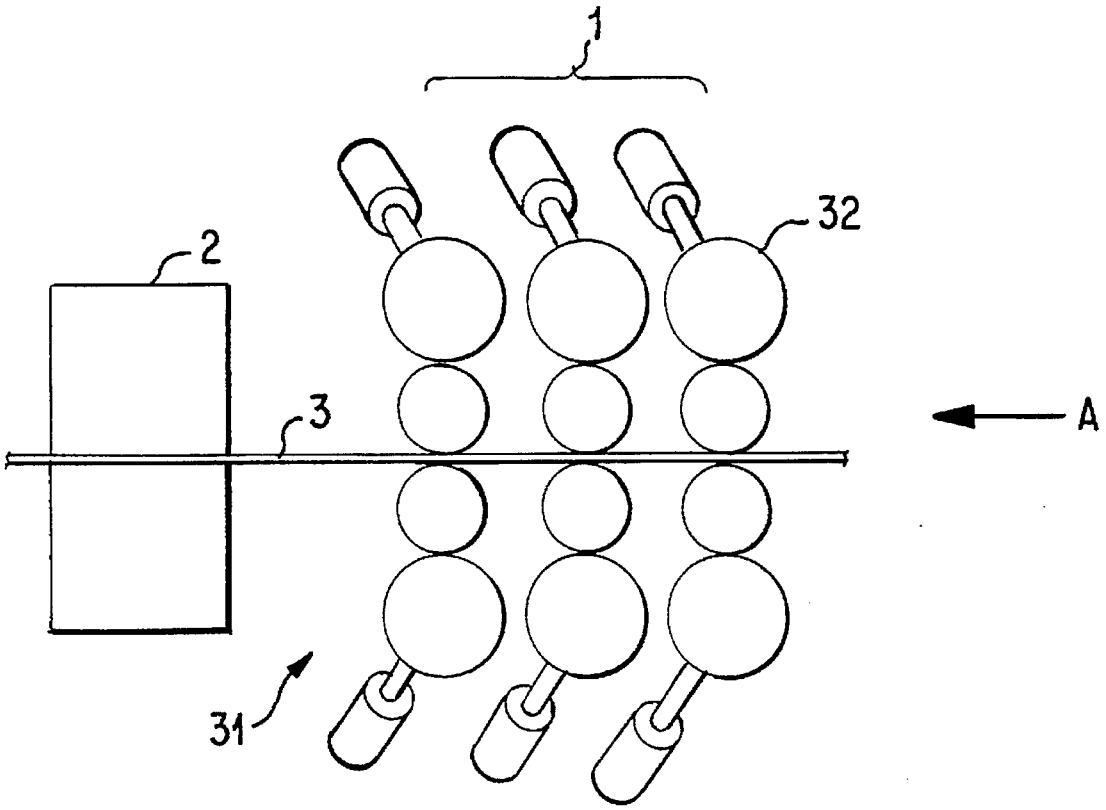
FIG. 19A is a view of a portion of FIG. 19 taken in the direction of arrow A.
Figure 19B:
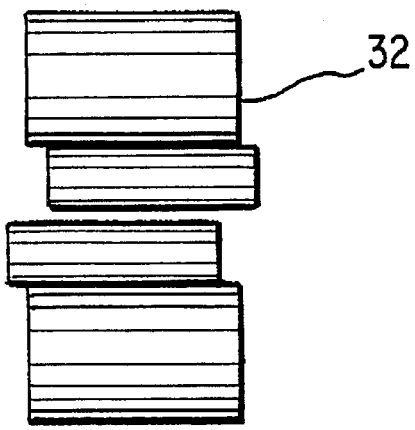
FIG. 19 is a schematic view showing an eleventh embodiment of a system for manufacturing thin plate by hot working according to the present invention.

FIGS. 19 and 19A schematically show another embodiment according to the present invention. In a system for manufacturing thin plate by hot working having a set of rolling mill stands 1 and a splicing machine 2, the set of rolling mill stand 1 placed in the process following the splicing machine 2 are constructed such that at least a rolling mill stand 32 has working rollers which are movable in the direction of the roller axis. By continuously splicing the plates 3 using the splicing machine 2 in advance of the rolling process, most portions of the rolled plates can be rolled under the steady state rolling condition, that is, the after-engaged rolling condition, and reducing amount of plate in most portions of rolling work can be substantially increased, which improves the rolling efficiency as also described for the other embodiments. Thereby, the diameter of working roller can be decreased, the rolling mills can be made small, and it can be realized to attain a small-scale system for manufacturing thin plate by hot working. Therefore, the rolling mill can be made small by employing the two-high rolling mill stand 31 in at least the first front rolling mill stand or the first and the second front rolling mill stands. Further, by constructing the set of rolling mill stands such that at least one rolling mill stand among the set of rolling mill stands is such a rolling mill stand 32 that the working rollers are movable in the direction of the roller axis, control capability for plate crown and plate shape is improved and consequently it is possible to well maintain the quality of plates. (See FIG. 19B showing offset adjustment).

Figure 20A:
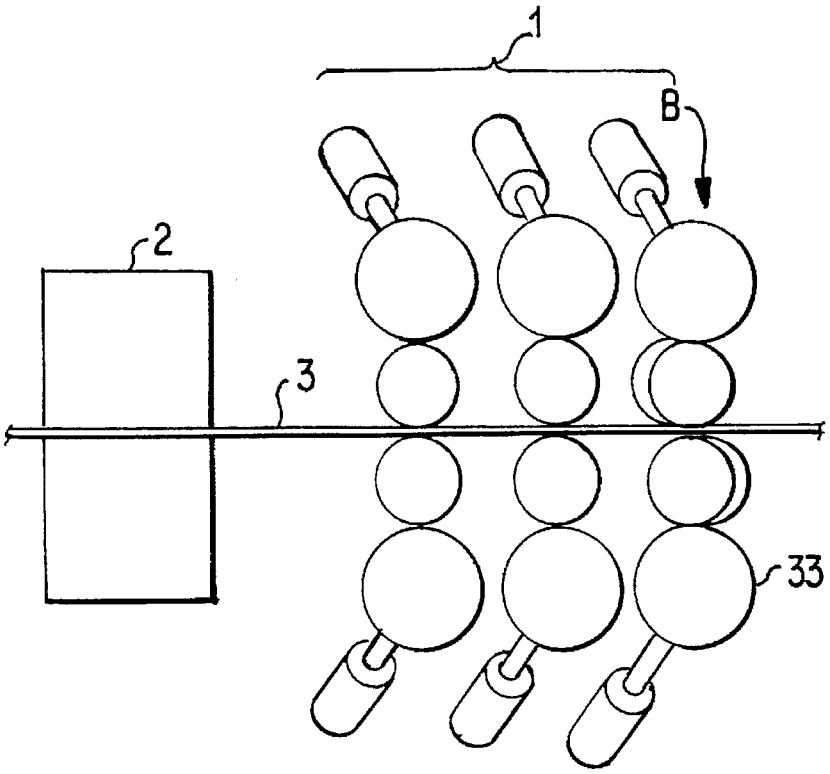
FIG. 20A is a schematic view showing a twelfth embodiment of a system for manufacturing thin plate by hot working according to the present invention.
Figure 20B:
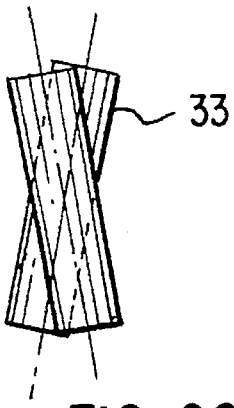
FIG. 20B is a view of a portion of FIG. 20 taken in the direction of arrow B of FIG. 20A.

FIGS. 20A and 20B schematically show another embodiment according to the present invention. In a system for manufacturing thin plate by hot working having a set of rolling mill stands 1 and a splicing machine 2, the set of rolling mill stands 1 placed in the process following the splicing machine 2 are constructed such that at least one rolling mill stand 33 is a rolling mill wherein the upper and the lower working rollers are crossed in the horizontal with respect to plane each other to vary the gap between the rollers (See FIG. 20B). By continuously splicing the plates 3 using the splicing machine 2 in advance of the rolling process, most portions of the rolled plates can be rolled under the steady state rolling condition, that is, the after-engaged rolling condition, and reducing amount of plate in most portions of the rolled product can be substantially increased, which improves the rolling efficiency, as also described for other embodiments. Further, by constructing the set of rolling mill stands such that at least one rolling mill stand among the set of rolling mills is a rolling mill 33 wherein the upper and the lower working rollers are crossed in the horizontal plane with respect to each other to vary the gap between the rollers, control capability for plate crown and plate shape is improved and consequently it is possible to keep the quality of plates well.

Figure 21:
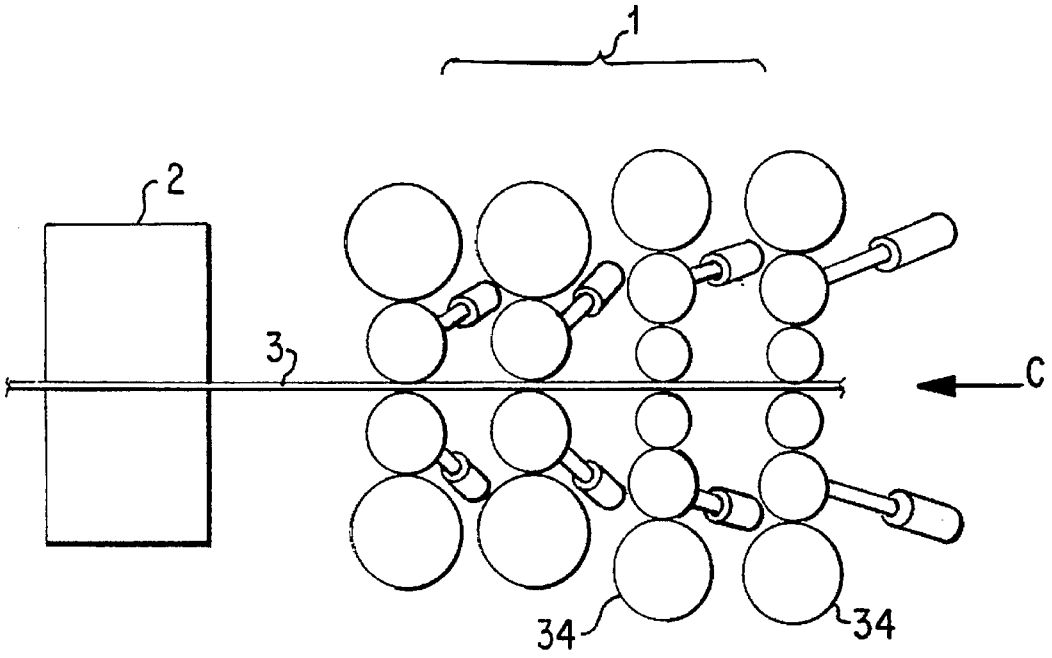
FIG. 21 is a schematic view showing a thirteenth embodiment of a system for manufacturing thin plate by hot working according to the present invention.
Figure 21A:
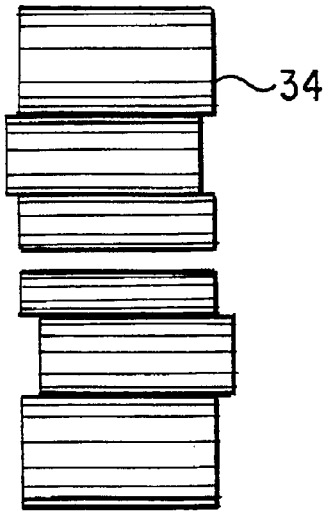
FIG. 21A is a schematic enlarged view showing a portion of the system of FIG. 21 taken in the direction of arrow C.

FIGS. 21 and 21A schematically show a further embodiment according to the present invention. In a system for manufacturing thin plate by hot working having a set of rolling mill stands 1 and a splicing machine 2, the set of rolling mill stands 1 placed in the process following the splicing machine 2 are constructed such that at least one rolling mill stand among the set of rolling mill stands is such a six-high rolling mill stand 34 that has intermediate rollers capable of moving in the axial direction and a working roller bender. By continuously splicing the plates 3 using the splicing machine 2 in advance of the rolling process, most portions of the rolled plates can be rolled under the steady state rolling condition, that is, the after-engaged rolling condition, and thickness reducing amount in most portions of the rolled product can be substantially increased, which improves the rolling efficiency, as also described for other embodiments. Further, by constructing the set of rolling mill stands such that at least one rolling mill stand among the set is a six-high rolling mill stand that has intermediate rollers capable of moving in the axial direction and a working roller bender, control capability for plate crown and plate shape is improved and consequently it is possible to keep the quality of plates well.

Figure 22:
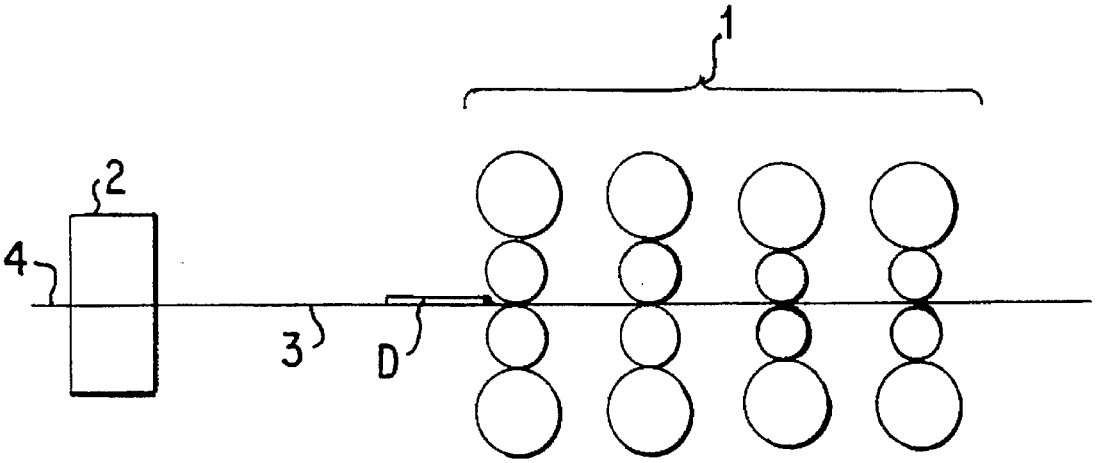
FIG. 22 is a schematic view showing a fourteenth embodiment of a system for manufacturing thin plate by hot working according to the present invention.

FIG. 22 is a schematic view showing another embodiment according to the present invention. In a system for manufacturing thin plate by hot working having a set of rolling mill stands 1 and a splicing machine 2, the rolling method comprises passing a dummy strip D through the set of rolling mill stands in advance of rolling a thin plate in the first place, splicing the dummy strip D and the first thin plate 3, and rolling the thin plate. By continuously splicing the plates 3 using the splicing machine 2 in advance of the rolling process, most portions of the rolled plates can be rolled under the steady state rolling condition, that is, the after-engaged rolling condition, and the thickness reducing amount of the plate in most portions of the rolled material can be substantially increased, which improves the rolling efficiency as also described for other embodiments. The use of a dummy strip D facilitates start up of rolling as the strip D can be tapered at its front edge. Also, use of the dummy strip reduces waste of the material.

Figure 23:
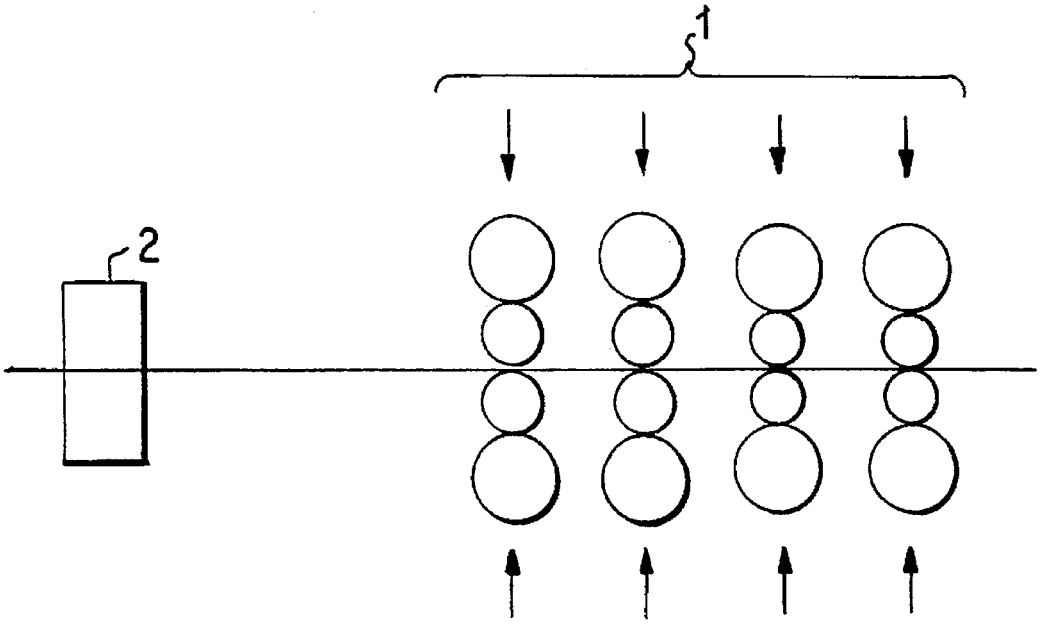
FIG. 23 is a schematic view showing a fifteenth embodiment of a system for manufacturing thin plate by hot working according to the present invention.

FIG. 23 is a schematic view showing another embodiment according to the present invention. In a system for manufacturing thin plate by hot working having a set of rolling mills 1 and a splicing machine 2, the rolling method comprises passing a thin plate through the set of rolling mills under a light pressure rolling condition when the front end of the thin plate is introduced and rolled in the first place, then rolling the thin plate under a given pressure. By continuously splicing the plates 3 using the splicing machine 2 in advance of the rolling process, most portions of the rolled plates can be rolled under the steady state rolling condition, that is, the after-engaged rolling condition, and the thickness reducing amount of the plate in most portions of rolling work can be substantially increased, which improves the rolling efficiency. Thereby, the diameter of working rollers can be decreased smaller than the diameter of working roller used in a conventional rolling mill, the rolling mill stands can be made small, and it can be realized to attain a small-scale system for manufacturing thin plate by hot working.

In performing a schedule with the FIG. 23 system where a thick object or plate section is rolled at the first place according to other contemplated embodiments, the same effect can be expected since the first rolling is performed under a comparatively low pressure. The mill stands of FIGS. 22 and 23 may be similar to the other illustrated embodiments and are thus not described in detail.

Figure 24A:
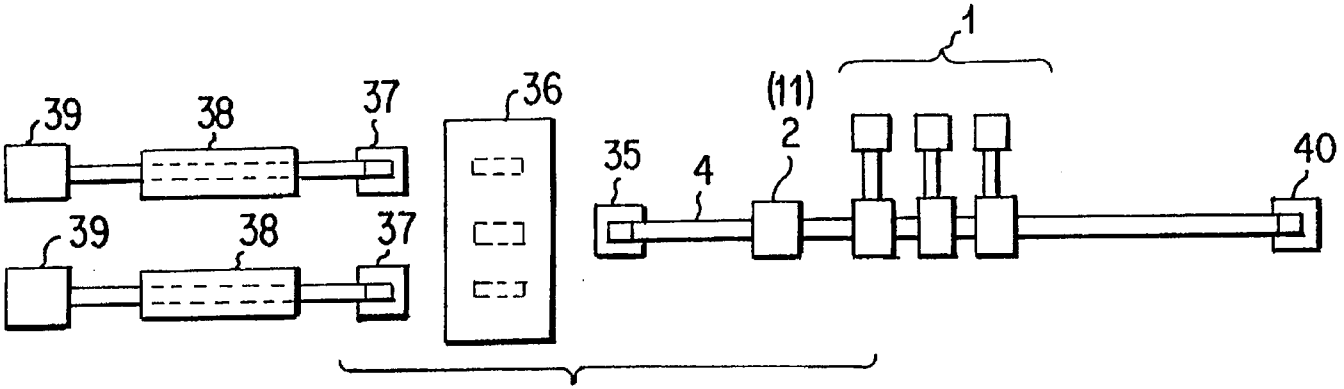
FIG. 24A is a schematic plan view showing an embodiment of a system for manufacturing thin plate by hot working according to the present invention.
Figure 24B:
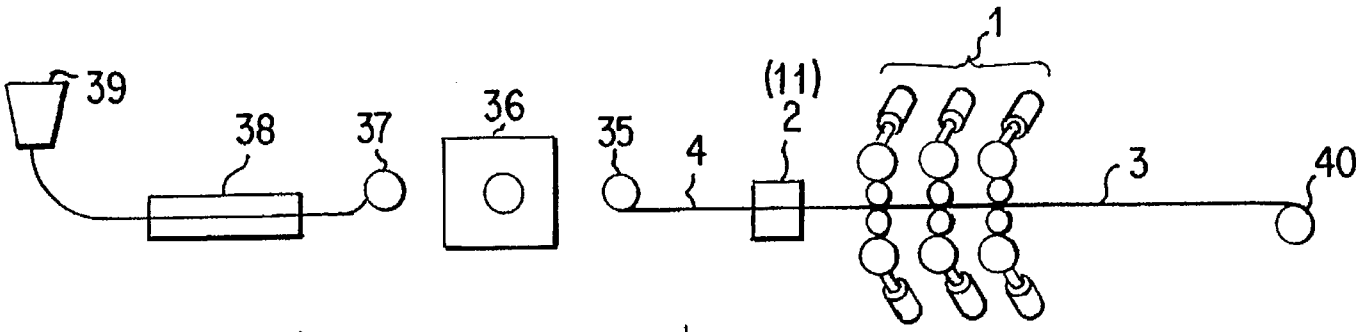
FIG. 24B is a side view of the system of FIG. 24A.

FIGS. 24A AND 24B schematically show an embodiment of a system for manufacturing thin plate by hot working according to the present invention. In the system of FIGS. 24A and 24B, a splicing machine 2 is placed in the process precedent to a set of rolling mill stands 1 having at least some stands with non-driven or indirectly driven small diameter working rollers, a winding-off coiler 35 being provided in the process precedent to the splicing machine 2, a tunnel furnace 36 having functions to take up, transfer and discharge a coil of plate being provided in the process precedent to the winding-off coiler 35, a winding-up coiler 37 being provided in the process precedent to the tunnel furnace 36, a soaking pit 38 being provided in the process precedent to the winding-up coiler 37, one or more continuous casting machines 39 for casting thin plate being provided in the process precedent to the soaking pit 38, and a down-coiler or a chain wrapper 40 being provided in the process following the set of rolling mill stands 1.

In other words, the process depicted in FIGS. 24A and 24B comprises casting a thin plate using one or more continuous casting machines 39, homogenizing the unevenness of temperature in the plate produced during casting using the soaking pit 38, winding up the thin plate using the winding-up coiler 37 to form a coil-shape to put into the tunnel furnace 36. Then, the process comprises warming or heating the coil-shaped thin plate in a tunnel furnace 36 to a temperature suitable for rolling, transferring the coil-shaped thin plate to a discharging port to discharge it to the winding-off coiler 35. By forming the plate into a coil-shape to warm or heat it, the necessary space is substantially decreased, and, further, it is possible to make matching in production speed between the continuous casting machine 39 and the set of rolling mills 1. By winding off the coil-shaped thin plate using the winding-off coiler 35 and continuously splicing the plates using the splicing machine 2 in advance of the rolling process, most portions of the rolled plates can be rolled under the steady state rolling condition, that is, the after-engaged rolling condition, and thickness reducing amount of the plate in most portions of the rolled product can be substantially increased, which substantially improves the rolling efficiency.

The rolled thin plate is wound up at the down-coiler or chain wrapper 40 installed at the tail end of the rolling mill stands. As a whole, it can be realized to minimize the size of the system for manufacturing thin plate by hot working. It is preferable to place the front end press 11, described above, in the process precedent to the set of rolling mill stands 1 to form the front edge portion of the thin plate continuously reducing its thickness toward the edge. Thereby, the engaging capability is improved and consequently material loss due to the engaging may be decreased since the reducing amount of plate can be increased even in the engaging process in the first place. The front end press is used only for the leading edge of the first plate to be introduced to the working rollers, the front end press being moved away from the following spliced plates.

Figure 25A:
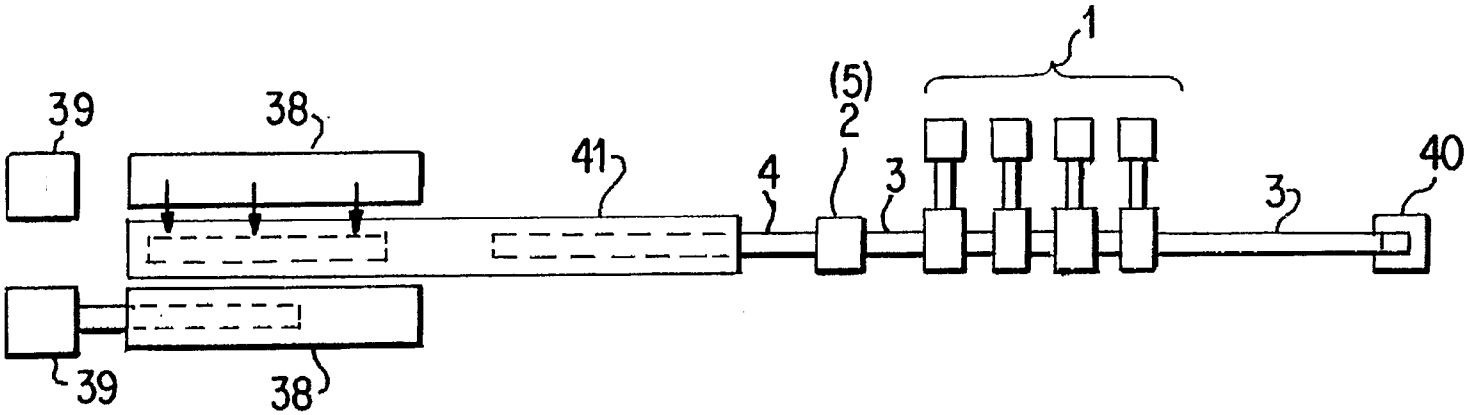
FIG. 25A is a schematic plan view showing an embodiment of a system for manufacturing thin plate by hot working according to the present invention.
Figure 25B:
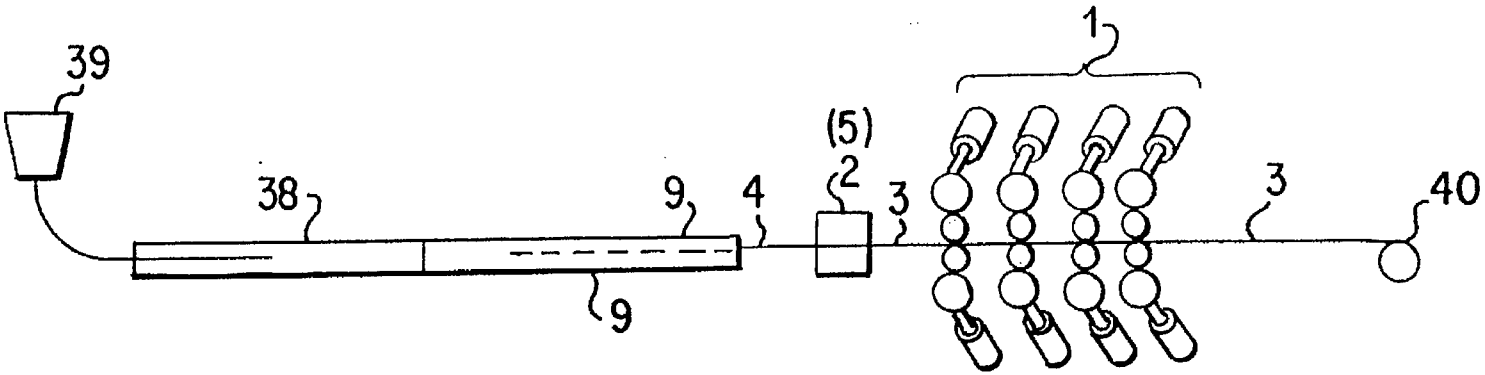
FIG. 25B is a side view of the system of FIG. 25.

FIGS. 25A and 25B are schematic views showing another embodiment of a system for manufacturing thin plate by hot working according to the present invention.

In the system depicted in FIGS. 25A and 25B, a splicing machine 2 is placed in the process precedent to a set of rolling mill stands 1 having at least some stands with non-driven or indirectly driven small diameter working rollers, a heating furnace 41 being provided in the process precedent to the splicing machine 2, a soaking pit 38 having functions to take up, transfer and discharge a coil of plate being provided in the process precedent to the heating furnace 41, one or more continuous casting machines 39 for casting thin plate being provided in the process precedent to the soaking pit 38, and a down-coiler or a chain wrapper 40 being provided in the process following to the set of rolling mill stands 1.

In other words, the process depicted in FIGS. 25A and 25B comprises casting a thin plate using one or more continuous casting machines 39, homogenizing the unevenness of temperature in the plate produced during casting using the soaking pit 38, putting the plate into a heating furnace 41. Then, the process comprises warming or heating the plate in the heating furnace 41 to a temperature suitable for rolling, transferring the plate to a discharging port. By continuously splicing the plates using the splicing machine 2, most portions of the rolled plates can be rolled under the steady state rolling condition, that is, the after-engaged rolling condition, and the thickness reducing amount of plate in most portions of rolled product can be substantially increased, which substantially improves the rolling efficiency. The rolled thin plate is wound up at the down-coiler or chain wrapper 40 installed in the tail process. As a whole, it can be realized to minimize the size of the system for manufacturing thin plate by hot working. It is preferable to place the front press 11, described above, in the process precedent to the set of rolling mills 1 to form the front edge portion of the thin plate continuously reducing its thickness toward the edge. Thereby, the engaging capability is improved and consequently material loss due to the engaging may be decreased since the reducing amount of plate can be increased even in the engaging process in the first place. This press 11 operates only after the start up end of the first plate part introduced to the working rollers, the following spliced plates passing through the press 11 without being disturbed.

Figure 26:
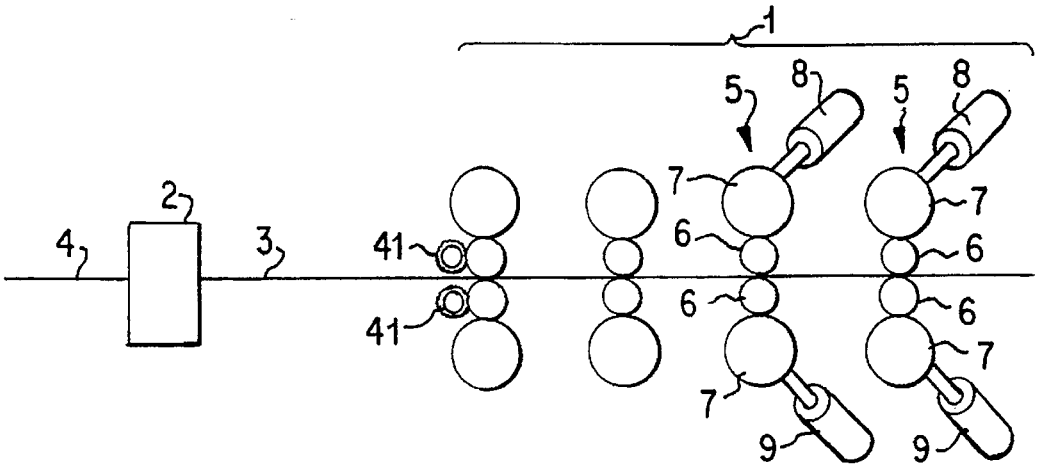
FIG. 26 is a schematic view showing another embodiment of a system for manufacturing thin plate by hot working according to the present invention.

FIG. 26 shows a system for manufacturing thin plate by hot-working according to the present invention which has a set of rolling mill stands 1 having at least some mill stands with non-driven small diameter working rollers and a splicing machine 2. A rotating grinding stone 41 is disposed to contact a working roller in a first stand of the set of rolling mill stands 1. When passing a first plate of a strip of plates through the set of rolling mill stands, the force pressing the rotating grinding stone against the working roller is increased to make the surface roughness of the working roller increase the friction coefficient between the roller and the plate to be rolled. Thereby, the limit in thickness reducing amount of plate for engaging the front edge of the plate is increased and it becomes easy to engage the plate with the roller. Once the first plate is engaged, it is possible to continue rolling after then. Therefore, the force pressing the rotating grinding stone against the working roller is returned to the normal force. After the engagement of the first plate, a precedent plate 3 and the following plates 4 are spliced to each other to be rolled continuously. The rotating grinding stone may be detached from the working roller during continuously rolling and pushed against the roller only when a first plate is to be passed through to start rolling of a strip of spliced plates.

As for the rotating grinding stone, various shapes are considered, including cylindrical, circular cone-shaped, disk-shaped and so on. Among them, a method of rotating disk-shaped grinding stones is preferable since it has a high grinding capability. The method is described in Japanese Patent Application Laid-Open No. 6-47654.

By only pushing a block-shaped grinding stone against the rotating roller instead of the rolling structure, the object of the present invention can also be attained.

Although the placing of the grinding stone in FIG. 26 is only at the working roller in the first stand, it is not limited to this location according to other contemplated embodiments. A grinding stone may be placed at each of the stands. Further a grinding stone may be placed not only at the working roller, but at the reinforcing roller. Particularly, in a case where the working roller in the first stand is a non-driving roller as different from the system in FIG. 26, the friction coefficient between the reinforcing roller and the working roller is increased by placing the grinding stone at the reinforcing roller. Thereby, the probability of occurrence of slip between the rollers is minimized when overloading torque occurs at engaging of a plate.

Figure 27:
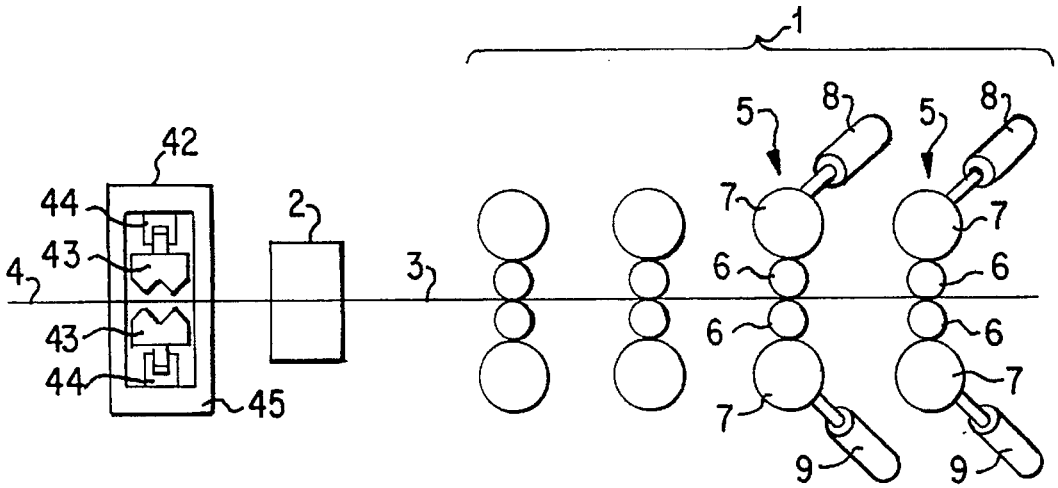
FIG. 27 is a schematic view showing another embodiment of a system for manufacturing thin plate by hot working according to the present invention.

FIG. 27 shows a system for manufacturing thin plate by hot-working according to the present invention which has a set of rolling mills 1 having at least some stands with non-driven small diameter working rollers and a splicing machine 2. A machine 42 for forming projections and depressions on the surface of a plate is placed in front of the splicing machine 2. The machine 42 for forming projections and depressions is composed of a die 43 having a projecting and depressing surface contained inside a housing 45 and a hydraulic pressure cylinder for pushing the die 43 against a plate to be rolled. In passing a first plate through the set of rolling mills, the die 43 is pressed against the front edge of the plate to form projections and depressions on it. By forming the projections and depressions on the surface of the plate, the limit in thickness reducing amount of plate for engaging the front edge of the plate is increased and it becomes easy to engage the plate with the roller. Once the plate is engaged, it is possible to continue rolling after then. After then, a precedent plate 3 and the following plate 4 are spliced to each other to be rolled continuously.

Various kinds of projection and depression forming machines and shapes of projections and depressions other than those shown in FIG. 27 are contemplated. Although the projections and depressions are formed in both surfaces of the plate in FIG. 27, they may also be formed on one side of the surfaces.

Figure 28:
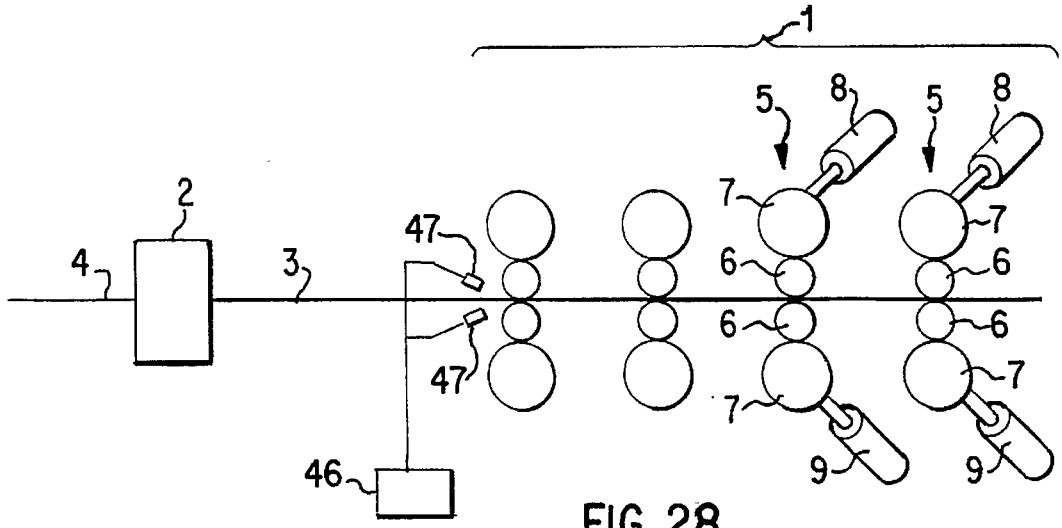
FIG. 28 is a schematic view showing another embodiment of a system for manufacturing thin plate by hot working according to the present invention.

FIG. 28 shows a system for manufacturing thin plate by hot-working according to the present invention which has a set of rolling mill stands 1 having at least some stands with non-driven small diameter working rollers and a splicing machine 2. A machine 46 for supplying a friction increasing agent and a nozzle 47 for spraying the friction increasing agent are placed near the working roller in the first stand of the set of rolling mill stands 1. In passing a first plate through the set of rolling mill stands, the friction increasing agent is sprayed between the working roller and the plate to increase the friction coefficient between the roller and the plate. Thereby, the limit in thickness reducing amount of plate for engaging the front edge of the plate is increased and it becomes easy to engage the place with the roller. Once the plate is engaged, it is possible to continue rolling after then. After then, a precedent plate 3 and the following plate 4 are spliced to each other to be rolled continuously.

Although various kinds of friction increasing agents can be considered, very small solid particles of sand-like material are commonly used. Although the friction increasing agent supplying machine 46 and the nozzle 47 are placed only at the working roller in the first stand in the illustrated embodiment of FIG. 28, the invention contemplates different locations for some.

It also contemplates to combine the method of increasing the friction coefficient between the roller and the plate in engaging the plate in the roller shown in FIG. 26 and FIG. 27 and the method of decreasing the thickness of the edges of the plates to increase the limit in the reducing amount of plate for engaging the front edge of the plate described above.

For FIGS. 26–28, details of the individual mill stands are not illustrated and described as they can be similar to the various other described embodiments of FIGS. 1–8.

Figure 29:
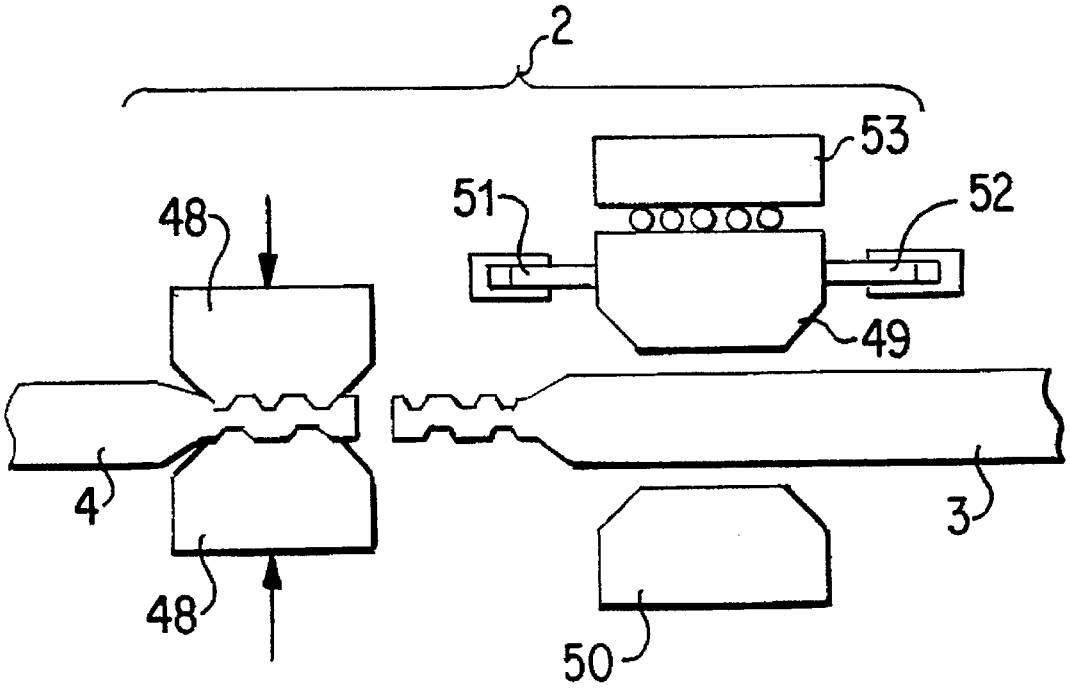
FIG. 29 is a schematic view showing another embodiment of a splicing machine in a system for manufacturing thin plate by hot working according to the present invention and a view explaining the method of splicing.
Figure 30:
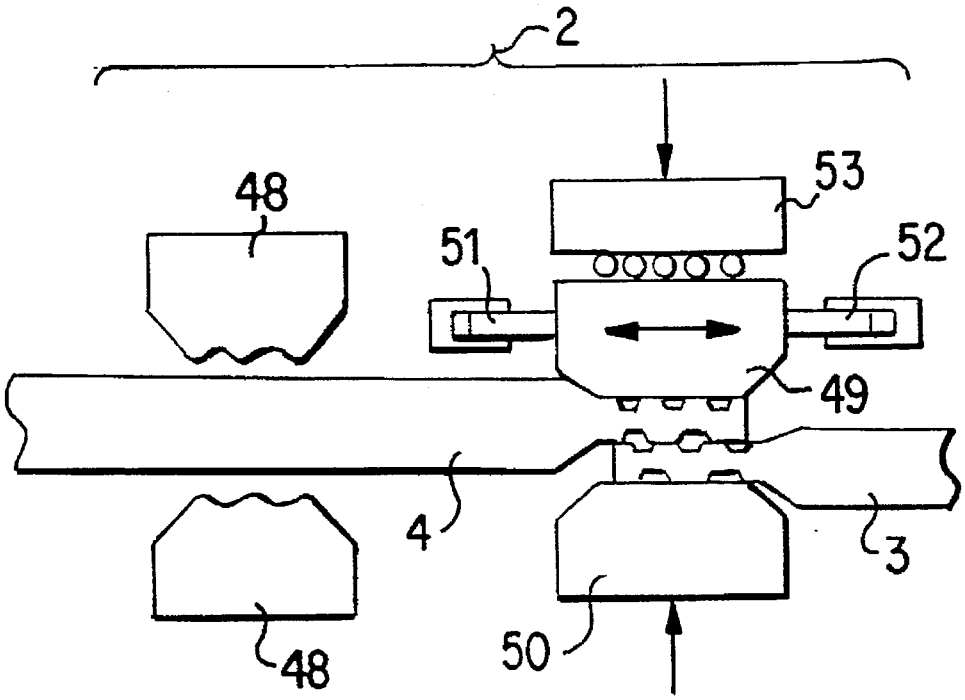
FIG. 30 is a schematic view showing another embodiment of a splicing machine in a system for manufacturing thin plate by hot working according to the present invention and a view explaining the method of splicing.

FIG. 29 shows a further embodiment of a splicing machine 2F. The splicing machine 2F is composed of a die 48 having projections and depressions on its surface and dies 49, 50 for sliding the plates in the rolling direction. The die 49 is mounted on a pressing block 53 through a roller and is slid by hydraulic pressure cylinders 51, 52. Firstly, the rear edge of the precedent plate 3 and the front edge of the following plate 4 are thinned with the die 48 and at the same time projections and depressions are formed on the surface.

Next, the rear edge of the precedent plate 3 and the front edge of the following plate 4 are superposed, and are interposed between the dies 49 and 50. The hydraulic pressure cylinders 51 and 52 are reciprocally moved under a stale of applying a pressing force on the plates in the vertical direction with the pressing block 53 and the die 50. The precedent plate 3 and the following plate 4 arc slid with respect to each other to splice the plates together. At this time, the oxide scales attached to the joining surfaces of the precedent plate 3 and the following plate 4 are removed by sliding and gathered in the indent portions formed in advance. Therefore, both of the fresh surfaces generated by removing the scales are tightly contacted to be spliced firmly. If there is no indenting portion, the scales removed remain between the joining surfaces to hinder splicing of the plates together. Therefore, reliability of splicing cannot be maintained.

By using the splicing machine described above, it is not necessary to additionally provide a machine for thinning the front edge portion of a first plate in passing the plate through the roller at the first place or a machine for increasing the friction coefficient between the roller and the plate. That is, when a first plate to be rolled is passed through the set of rolling mills, the thickness of the front edge of the plate is thinned and projections and depressions are formed on the front edge. Thereby, the thickness of the plate is decreased and the friction coefficient between the roller and the plate is increased, and consequently the limit in reducing amount of plate for engaging the front edge of plate is increased. Of course, only the dies 49 and 50 may be used for thinning the front edge of the plate instead of using the die 48. Once the plate is engaged with the roller, continuous rolling after then can be performed. A precedent plate 3 and the following plate 4 are spliced to each other using the splicing machine 2 to perform continuous rolling.

As described above, the present invention makes it possible to provide a system for manufacturing thin plate strips by hot working and a method for manufacturing a plate strip by hot working which is capable of stably manufacturing high quality plate strips using a compact manufacturing system by combining and installing a set of rolling mill stands having at least some stands with small diameter working rollers and a splicing machine for thin plates to maintain the engaging capability of the rolling mill stands having small diameter working rollers.

In especially preferred embodiments of the invention, the thickness of the casted plate strip from the casting machine is between 70 mm and 100 mm, the number of rolling mill stands is no more than four rolling mill stands, the diameter of the working rollers for the stands with non-driven working rollers is less than 700 mm and preferably between 300 and 400 mm. In preferred embodiments, only finishing mill stands are used as roughing mill stands can be dispensed with due to the novel combination of features which facilitate use of small diameter working rollers to roll the plate, which is continually spliced and continuously supplied from the splicer to the rolling mill stands. The cast pieces themselves are spliced in preferred embodiments, then rolled hot in the small diameter working roller mill stands.

In preferred embodiments, the hot strip plates have a temperature of 900° to 1100° C. at the splicer and a temperature of 800° C. or slightly less at the position immediately downstream of the last rolling mill stand.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A system for manufacturing thin plate comprising:

thin cast slab plate conveying means for conveying a plurality of thin cast slab plates with a thickness of less than 100 mm adjacent one another in a heated condition, a splicer disposed downstream of the thin cast slab plate supply means in the travel path of the cast slab plates and including splicing means for continuously splicing facing ends of adjacent ones of the slab plates together to thereby form a continuous strip of spliced together slab plates, and a plurality of hot rolling finishing mill stands for continuous rolling of the continuous strip of spliced together slab plates, at least one of said hot rolling finishing mill stands having only one pair of small diameter working rollers which are driven by respective supporting rollers and are not directly rotatably driven, thereby facilitating high rolling loads at the at least one mill stand with only one pair of small diameter working rollers.

2. A system according to claim 1, comprising a front edge press for tapering a front edge port, on of a first slab plate of the continuous strip of slab plates for aiding in engagement of the front edge portion by working rollers of the rolling mill stands.

3. A system according to claim 1, comprising:

a winding-off coiler provided upstream of said splicer, a tunnel furnace having functions to take up, transfer and discharge a coil of said cast plate provided upstream of said winding-off coiler;

a winding-up coiler provided upstream of said tunnel furnace;

a soaking pit provided upstream of the winding-up coiler;

at least one continuous casting machine for casting the thin plates provided upstream of said soaking pit; and one of a down-coiler and a chain wrapper provided downstream of said plurality of rolling mill stands.

4. A system according to claim 1, comprising:

a heating furnace capable of discharging said thin cast plate provided upstream of said splicer;

a soaking pit capable of taking up, transferring and discharging said thin cast plate provided upstream of said heating furnace;

at least one continuous casting machine for casting the thin plate provided upstream of said soaking pit; and one of a down coiler and a chain wrapper provided the downstream of said plurality of rolling mill stands.

5. A system according to claim 2, wherein said front edge press comprises anvil blocks with a taper portion and a parallel portion.

6. A system according to claim 2, wherein said front edge press comprises rotatable upper and lower anvil blocks, an off-set being provided between a line connecting between upper and lower rotating centers of the anvil blocks and the minimum bite gap portion between the upper and the lower anvil blocks.

7. A system according to claim 1, wherein said splicer comprises:

cutting means for cutting a rear edge of a precedent plate and a front edge of a following plate, melt-planing means having a plurality of melt-planing torches arranged in a width direction of the plate, transferring means for moving said melt-planning torches in the width direction of the plates, pressing means for applying pressing force to the interface of the rear edge of the precedent plate and the front edge of the following plate.

8. A system according to claim 1, wherein said splicer comprises:

cutting means for cutting a rear edge of a precedent plate and a front edge of a following plate, induction heating coils arranged at the upper and the lower surfaces of said plates to inductively heat butt surfaces of the plates, and pressing means for applying pressing force to the interface of said butt surfaces.

9. A system according to claim 1, wherein said splicer comprises:

cutting means for cutting a rear edge of a precedent plate and a front edge of a following plate, arc generating means for locally generating arc by conducting current in a gap between butt surfaces of plates, arc transferring means for moving said arc generating means in a width direction of the plate, and pressing means for applying pressing force to the butt interface of the rear edge of the precedent plate and the front edge of the following plate.

10. A system according to claim 1, wherein said splicer comprises:

cutting means for cutting a rear edge of a precedent plate and a front edge of a following plate, oxygen gas jetting means for jetting oxygen gas to at least one edge surface of the rear edge of the precedent plate and the front edge of the following plate, iron powder mixing means for mixing iron powder in the oxygen gas, and pressing means for applying pressing force to the contacting surfaces of the rear edge of the precedent plate and the front edge of the following plate.

11. A system according to claim 1, wherein said splicer comprises:

cutting means for cutting a rear edge of a precedent plate and a front edge of a following plate, plate vibrating means for vibrating at least one of the rear edge of the precedent plate and the front edge of the following plate, and pressing means for applying pressing force to the contacting surfaces of the rear edge of the precedent plate and the front edge of the following plate.

12. A system according to claim 1, wherein said plurality of rolling mill stands are constructed such that at least a first front rolling mill stand or first and second front rolling mill stands are four-high rolling mill stands.

13. A system according to claim 1, wherein said plurality of rolling mill stands are constructed such that at least a first front rolling mill stand or first and second front rolling mill stands have working rollers made of a material for high temperature and the other downstream rolling mill stands have working rollers made of a material for lower temperature, the materials for the working rollers being different from each other at the respective mill stands.

14. A system according to claim 1, wherein at least one rolling mill stand among said set of rolling mill stands has working rollers which are movable in the direction of the working roller axes.

15. A system according to claim 1, wherein at least one rolling mill stand among said plurality rolling mill stands is a rolling mill stand wherein upper and lower working rollers are crossed in the horizontal plane with respect to each other to vary the gap between the rollers.

16. A system according to claim 1, wherein at least one rolling mill stand among said plurality of rolling mill stands is a six-high rolling mill stand that has a working roller bender and intermediate rollers capable of moving in the axial direction.

17. A system according to claim 1, comprising:

a machine for increasing a friction coefficient between a working roller and a plate to be rolled at an engaging condition of the plate with the working roller.

18. A system according to claim 17, wherein said machine for increasing friction coefficient is a machine to grind a working roller installed in a rolling mill stand.

19. A system according to claim 17, wherein said machine for increasing friction coefficient is a machine for forming projections and depressions on a surface of a front edge of a thin plate.

20. A system according to claim 17, wherein said machine for increasing friction coefficient is a machine for supplying friction increaser material between the working roller and a plate to be rolled.

21. A system for manufacturing thin plate by hot working according to claim 1, wherein said splicer comprises:

pressing means for superposing and pressing a rear edge of a precedent plate and a front edge of a following plate;

sliding means for sliding the rear edge of said precedent plate and the front edge of said following plate superposed and pressed against each other; and indent forming means for forming at Least one indent portion on at least one of the superposed surfaces of the rear edge of said precedent plate and the front edge of said following plate.

22. A system for manufacturing thin late by hot working according to claim 1, wherein said splicer comprises:

thinning means for thinning each of a rear edge of a precedent plate and a front edge of a following plate:

pressing means for superposing and pressing the rear edge of the precedent plate and the front edge of the following plate thinned with said thinning means; and sliding means for sliding the rear edge of said precedent plate and the front edge of said following plate superposed and pressed against each other;

wherein said thinning means has means for forming at least one indent portion on at least one of the superposed surfaces of the rear edge of said precedent plate and the front edge of said following plate.

23. A system according to claim 1, wherein said plurality of finishing mill stands includes at most four mill stands.

24. A system according to claim 3, wherein said plurality of finishing mill stands includes at most four mill stands.

25. A system according to claim 4, wherein said plurality of finishing mill stands includes at most four mill stands.

26. A system according to claim 1, wherein said working rollers which are not directly rotatably driven have a diameter less than 600 mm.

27. A system according to claim 1, wherein said working rollers which are not directly rotatably driven have a diameter of between 300 and 400 mm.

28. A system according to claim 3, wherein said mill stands consist of three four-high mill stands having respective working rollers indirectly driven by respective reinforcing rollers driven by electric motor means.

29. A system according to claim 28, wherein said working rollers of each of said stands have a diameter of between 300 and 400 mm.

30. A method for manufacturing thin plate comprising:

conveying a plurality of heated thin cast slab plates with a thickness of less than 100 mm adjacent one another in a heated condition, continuously splicing facing ends of adjacent ones of the heated slab plates while conveying same to thereby form a continuous strip of spliced together heated slab plates, and hot rolling said continuous strip of heated slab plates at a plurality of serially arranged hot rolling finishing mill stands, at least one of said hot rolling finishing mill stands having only one pair of small working rollers which are driven by respective supporting rollers and are not directly rotatably driven, thereby facilitating high rolling loads at the at least one mill stand with only one pair of small diameter working rollers.

31. A method according to claim 30, wherein all of said working rollers of the mill stands are other than directly rotatably driven.

32. A method according to claim 30, further comprising:

tapering the front edge of a first plate of said continuous strip using a front edge press, and introducing the tapered front edge to the first rolling mill stand to initiate engagement of the strip for rolling operation.

33. A method according to claim 30, further comprising:

casting thin plate using at least one continuous casting machines, winding up the thin plate to form a coil-shape using a winding-up coiler;

heating said coil-shaped thin plate in a tunnel furnace;

winding off the coil-shaped thin plate heated in said tunnel furnace and supplying same to the conveyor.

34. A method according to claim 33, comprising winding up said thin plate rolled using one of a down-coiler or a chain wrapper.

35. A method according to claim 30, further comprising:

casting thin plate using at least one continuous casting machine;

heating said thin plate after casting in a soaking pit;

transferring said thin plate heated in the soaking pit to a heating furnace to heat the thin plate at a given temperature in said heating furnace;

and supplying said thin plate to a splicer for said splicing.

36. A method according to claim 35, further comprising winding up said thin plate after said rolling using one of a down-coiler and a chain wrapper.

37. A method according to claim 32, wherein said tapering comprises using said front edge press having anvil blocks with a taper portion and a parallel portion.

38. A method according to claim 32, wherein said tapering comprises using said front edge press having rotatable upper and lower anvil blocks, an off-set being provided a line connecting between upper and lower anvil block rotating centers and the minimum bite gap portion between the upper and the lower anvil blocks.

39. A method according to claim 30 wherein said splicing comprises:

cutting a rear edge of a precedent plate and a front edge of a following plate perpendicular to the rolling direction, melt-planing at least one of the rear edge of the precedent plate and the front edge of the following plate in the width direction of the rolled plate by blowing jet flow of melt-planing torches to a portion with a green width from the edge, forming a splicing surface on the edge surface by said melt-planning, and applying pressing force to the splicing surfaces to splice the thin plates.

40. A method according to claim 30, wherein said splicing comprises:

cutting a rear edge of a precedent thin plate and a front edge of a following thin plate, butting the rear edge of the precedent thin plate and the front edge of the following thin plate with a gap between the rear edge of the precedent thin plate and the front edge of the following thin plate, inductively heating the butt surfaces of the thin plates by induction heating coils arranged at the upper and the lower surfaces of said thin plate, and applying pressing force to the interface of said butt surfaces to splice the rear edge of the precedent thin plate and the front edge of the following thin plate.

41. A method according to claim 30, wherein said splicing comprises:

cutting a rear edge of a precedent thin plate and a front edge of a following thin plate, butting the rear edge of the precedent thin plate and the front edge of the following thin plate with a gap between the rear edge of the precedent thin plate and the front edge of the following thin plate, conducting direct current in the gap to locally generate arc and concurrently applying alternating magnetic field in the thickness direction of said gap to create magnetic force in the width direction to said arc, heat-melting each of the rear edge of the precedent thin plate and the front edge of the following thin plate in the width direction of the thin plates by the arc moving in the width direction of the thin plates, forming a splicing surface in each of the edges, and applying pressing force to the interface of said butt surfaces to splice the rear edge of the precedent thin plate and the front edge of the following thin plate.

42. A method for according to claim 30, wherein said splicing comprises:

cutting a rear edge of a precedent thin plate and a front edge of the following thin plate, jetting oxygen gas and iron powder, if necessary, to at least one edge surface of the rear edge of the precedent plate and the front edge of the following plate to heat-melt and concurrently to blow off oxidized scales, forming a splicing surface in each of the rear edge of the precedent thin plate and the front edge of the following thin plate, and applying pressing force to the splicing surfaces to splice the rear edge of the precedent plate and the front edge of the following plate.

43. A method according to claim 30, wherein said splicing comprises:

cutting a rear edge of a precedent thin plate and a front edge of a following thin plate, vibrating at least one edge surface of the rear edge of the precedent plate and the front edge of the following plate to form splicing surfaces, and applying pressing force to the splicing surfaces to splice the rear edge of the precedent plate and the front edge of the following plate.

44. A method according to claim 30, wherein said rolling said thin plate includes using a set of said rolling mill stands constructed such that at least a first front rolling mill stand or first and second front rolling mill stands are four-high rolling mill stands.

45. A method according to claim 30, wherein said rolling said thin plate includes using a set of said rolling mill stands constructed such that at least a first front rolling mill stand or first and second front rolling mill stands have working rollers made of a material for high temperature and the other rolling mill stands have working rollers made of a material for lower temperature, the materials for the working rollers being different from each other.

46. A method according to claim 30, wherein said rolling said thin plate includes using a set of rolling mill stands constructed such that at least one rolling mill stand has working rollers adjustably movable in the direction of the roller axis.

47. A method according to claim 30, wherein said rolling said thin plate includes using a set of rolling mill stands constructed such that at least one rolling mill stand has upper and lower working rollers crossed in the horizontal plane with respect to each other to vary the gap between the rollers.

48. A method according to claim 30, wherein said rolling said thin plate includes using a set of rolling mill stands constructed such that at least one rolling mill stand is a six-high rolling mill stand that has a working roller bender and intermediate rollers capable of moving in the axial direction.

49. A method according to claim 30, comprising passing a dummy strip through said set of rolling mills in advance of rolling a first thin plate, splicing said dummy strip and said thin plate strip, and rolling said thin plate.

50. A method according to claim 30, comprising cutting out said dummy strip after said rolling.

51. A method according to claim 30, comprising passing a first end of said thin plate strip through said set of rolling mills under a light pressure rolling condition when the thin plate is rolled in the first place, then rolling the thin plate under a given higher rolling pressure.

52. A method according to claim 51, comprising performing rolling by a rolling schedule in which a thick plate is rolled in the first place.

53. A method according to claim 30, comprising engaging an upstream end of the plate strip in a state of increasing friction coefficient between the roller and said plate strip prior to said rolling.

54. A method according to claim 30, wherein said splicing comprises:

superposing and pressing the rear edge of the precedent plate and the front edge of the following plate;

a second process for sliding the rear edge of said precedent plate and the front edge of said following plate superposed and pressed against each other; and a third process for forming at least one indent portion on at least one of the superposed surfaces of the rear edge of said precedent plate and the front edge of said following plate.

55. A method according to claim 30, wherein said splicing comprises:

a process for thinning each of the rear edge of the precedent plate and the front edge of the following plate;

a process for superposing and pressing the rear edge of the precedent plate and the front edge of the following plate;

a process for sliding the rear edge of said precedent plate and the front edge of said following plate superposed and pressed against each other; and a process for forming at least one indent portion on at least one of the superposed surfaces of the rear edged of said precedent plate and the front edge of said following plate.

56. A method according to claim 30, wherein:

in rolling a first plate to be rolled using said set of rolling mill stands, forming projections and depressions on the surface of the front edge of only said first plate using means for forming at least one indent portion on the front edge of the first plate; then rolling the first plate using the set of rolling mill stands having non-driving small diameter working rollers; and in rolling the plates following the first plate using said set of rolling mill stands, continuously splicing the rear edge of a precedent plate to the front edge of the following plate, then rolling the plate using the set of rolling mill stand having non-driven small diameter working rollers.

57. A method according to claim 30, wherein:

in rolling a first plate to be rolled using said set of rolling mill stands, thinning the front edge of said first plate using thinning means for thinning only the front edge of the first plate; then rolling the first plate using the set of rolling mill stands having non-driven small diameter working rollers; and in rolling the plates following the first plate using said set of rolling mill stands, continuously splicing the rear edge of a precedent plate to the front edge of the following plate, then rolling the plate using the set of rolling mill stands having non-driven small diameter working rollers.

58. A method according to claim 30, wherein said plurality of finishing mill stands includes at most four mill stands.

59. A method according to claim 33, wherein said plurality of finishing mill stands includes at most four mill stands.

60. A method according to claim 35, wherein said plurality of finishing mill stands includes at most four mill stands.

61. A method for manufacturing thin plate comprising:

conveying a plurality of thin cast slab plates with a thickness of less than 100 mm adjacent one another in a heated condition, continuously splicing facing ends of adjacent ones of the slab plates while conveying same to thereby form a continuous strip of spliced together slab plates, and hot rolling said continuous strip of slab plates at a plurality of serially arranged hot rolling finishing mill stands, at least some of said hot rolling finishing mill stands having working rollers which are not directly rotatably driven, wherein said working rollers which are not directly driven have a diameter of between 300 and 400 mm.

62. A method according to claim 31, wherein said working rollers have a diameter of between 300 and 400 mm.

63. A method according to claim 33, wherein said mill stands consist of three four-high mill stands having respective working rollers indirectly driven by respective reinforcing rollers driven by electric motor means.

64. A system according to claim 1, wherein a plurality of said hot rolling mill stands have only one pair of small diameter working rollers which are driven by respective backup rollers and are not directly rotatably driven.

65. A method according to claim 30, wherein a plurality of said hot rolling mill stands have only one pair of small diameter working rollers which are driven by respective backup rollers and are not directly rotatably driven.

66. A system for manufacturing thin plate comprising:

a thin cast heated slab plate conveyor, a splicer disposed downstream of said thin cast heated slab plate conveyor in the travel path of the cast slab plates which in use continuously splice the spacing ends of adjacent ones of the slab plates together to thereby form a continuous strip of spliced together slab plates, and a plurality of hot rolling finishing mill stands disposed downstream of the splicer to continuously roll the continuous strip of spliced together slab plates, at least one of said plurality of hot rolling finishing mill stands having only one pair of small diameter working rollers and respective backup rollers backing up and rotatably driving said working rollers.

67. A system according to claim 66, wherein said conveyor conveys thin cast slab plates having a thickness of less than 100 mm.

68. A system according to claim 66, wherein a plurality of said hot rolling mill stands have only one pair of small diameter working rollers which are driven by respective backup rollers and are not directly rotatably driven.

69. A method of manufacturing thin plate comprising:

conveying a plurality of thin cast slab plates adjacent one another in a heated condition, said plurality of thin cast slab plates each having a thickness of less than 100 mm, continuously splicing facing ends of adjacent ones of the conveyed heated slab plates together to thereby form a continuous strip of spliced together slab plates, and continuously rolling the continuous strip of spliced together slab plates in a plurality of hot rolling finishing mill stands, at least one of said plurality of hot rolling finishing mill stands having only one pair of small diameter working rollers, said rolling including indirect rotating drive of said small diameter working rollers by way of backup rollers engaging said small diameter working rollers.

70. A method according to claim 69, wherein a plurality of said hot rolling mill stands have only one pair of small diameter working rollers which are driven by respective backup rollers and are not directly rotatably driven.

71. A system according to claim 1, wherein said at least one of said hot rolling finishing mill stands is a four high rolling mill stand and said supporting rollers are backup rollers.

72. A system according to claim 1, wherein said at least one of said hot rolling finishing mill stands is a six high rolling mill stand and said supporting rollers are intermediate rollers.

73. A method according to claim 30, wherein said at least one of said hot rolling finishing mill stands is a four high rolling mill stand and said supporting rollers are backup rollers.

74. A method according to claim 30, wherein said at least one of said hot rolling finishing mill stands is a six high rolling mill stand and said supporting rollers are intermediate rollers.

* * * * *